US010974521B2

(12) United States Patent
Nakata et al.

(10) Patent No.: US 10,974,521 B2
(45) Date of Patent: Apr. 13, 2021

(54) LIQUID DROPLET DISCHARGING APPARATUS, LIQUID DROPLET DISCHARGING METHOD, AND NON-TRANSITORY COMPUTER READABLE MEDIUM

(71) Applicant: RICOH COMPANY, LTD., Tokyo (JP)

(72) Inventors: Tetsuyoshi Nakata, Kanagawa (JP); Yasunari Harada, Kanagawa (JP); Jun Watanabe, Tokyo (JP); Hideaki Iijima, Kanagawa (JP); Toshiaki Hosokawa, Shiga (JP); Shunsuke Shitaoka, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 80 days.

(21) Appl. No.: 15/904,475

(22) Filed: Feb. 26, 2018

(65) Prior Publication Data

US 2018/0250947 A1 Sep. 6, 2018

(30) Foreign Application Priority Data

Mar. 3, 2017 (JP) ..... JP2017-041169

(51) Int. Cl.
*B41J 3/36* (2006.01)
*B41J 2/21* (2006.01)
*B41J 2/155* (2006.01)

(52) U.S. Cl.
CPC ..... *B41J 3/36* (2013.01); *B41J 2/155* (2013.01); *B41J 2/2135* (2013.01); *B41J 2/2139* (2013.01); *B41J 2/2142* (2013.01); *B41J 2/2146* (2013.01)

(58) Field of Classification Search
CPC . B41J 2/2135; B41J 3/36; B41J 2/2139; B41J 2/2146; B41J 2/2142; B41J 2/155
See application file for complete search history.

(56) References Cited

U.S. PATENT DOCUMENTS 5,927,872 A * 7/1999 Yamada ..... B41J 2/36 400/88
8,096,713 B1 1/2012 Bledsoe et al.
8,297,858 B1 10/2012 Bledsoe et al.
8,485,743 B1 7/2013 Bledsoe et al.
8,613,493 B1 12/2013 Burke et al.
(Continued)

FOREIGN PATENT DOCUMENTS

JP 2010-522650 7/2010
JP 2016-060103 4/2016
(Continued)

OTHER PUBLICATIONS

Extended European Search Report dated Jul. 2, 2018 in European Patent Application No. 18158910.2, 13 pages.

*Primary Examiner* — Justin Seo
(74) *Attorney, Agent, or Firm* — Xsensus LLP

(57) ABSTRACT

A liquid droplet discharging apparatus is movable and includes a plurality of nozzles to discharge a liquid droplet onto a medium according to a first image data section and a second image data section of image data. A moving amount sensor detects a moving amount of the liquid droplet discharging apparatus. A switcher switches from the first image data section to the second image data section based on the detected moving amount.

17 Claims, 19 Drawing Sheets

(56) References Cited

U.S. PATENT DOCUMENTS

| | | | | |
|---|---|---|---|---|
| 2002/0158955 | A1 | 10/2002 | Hess et al. | |
| 2007/0057089 | A1 | 3/2007 | Schroeter | |
| 2007/0263062 | A1 | 11/2007 | Noe et al. | |
| 2008/0075512 | A1 | 3/2008 | Gates et al. | |
| 2008/0204489 | A1 | 8/2008 | McKinley et al. | |
| 2008/0211864 | A1 | 9/2008 | Mealy et al. | |
| 2010/0128072 | A1* | 5/2010 | Wagner | B41J 3/36 347/5 |
| 2010/0149556 | A1 | 6/2010 | Noe et al. | |
| 2011/0039021 | A1 | 2/2011 | Persson et al. | |
| 2011/0298862 | A1 | 12/2011 | Mealy et al. | |
| 2012/0299995 | A1 | 11/2012 | Mealy et al. | |
| 2013/0122186 | A1 | 5/2013 | Hoppel | |
| 2013/0155146 | A1 | 6/2013 | Mealy et al. | |
| 2015/0110950 | A1 | 4/2015 | Hoppel et al. | |
| 2016/0082719 | A1 | 3/2016 | Harada et al. | |
| 2016/0239727 | A1 | 8/2016 | Trissel et al. | |
| 2017/0197444 | A1* | 7/2017 | Hosokawa | B41J 2/125 |

FOREIGN PATENT DOCUMENTS

| | | | |
|---|---|---|---|
| JP | 2016-87880 | A | 5/2016 |
| WO | WO2008/103998 | A1 | 8/2008 |

* cited by examiner

LIQUID DROPLET DISCHARGING APPARATUS, LIQUID DROPLET DISCHARGING METHOD, AND NON-TRANSITORY COMPUTER READABLE MEDIUM

CROSS-REFERENCE TO RELATED APPLICATION

This patent application is based on and claims priority pursuant to 35 U.S.C. § 119 to Japanese Patent Application No. 2017-041169, filed on Mar. 3, 2017, in the Japanese Patent Office, the entire disclosure of which is hereby incorporated by reference herein.

BACKGROUND

Technical Field

Exemplary embodiments generally relate to a liquid droplet discharging apparatus, a liquid droplet discharging method, and a non-transitory computer readable medium, and more particularly, to a liquid droplet discharging apparatus for discharging a liquid droplet onto a medium, a liquid droplet discharging method performed by the liquid droplet discharging apparatus, and a non-transitory computer readable medium for performing the liquid droplet discharging method.

Background Art

A related-art printer discharges liquid such as ink onto a sheet when the sheet conveyed by a sheet conveyer reaches an image forming position, thus forming an image on the sheet. Conversely, a liquid droplet discharging apparatus such as a handy mobile printer (HMP) does not incorporate the sheet conveyer and is downsized. A user moves the HMP to scan the sheet while the HMP discharges ink onto the sheet according to image data having a plurality of image data sections.

However, the user may be requested to operate the HMP for each of image data. For example, the user presses a button on the HMP to start printing. Accordingly, even if a plurality of images is printed on a single sheet according to the plurality of image data sections, respectively, the user may be requested to press the button on the HMP to switch between the plurality of image data sections.

SUMMARY

This specification describes below an improved liquid droplet discharging apparatus. In one embodiment, the liquid droplet discharging apparatus is movable and includes a plurality of nozzles to discharge a liquid droplet onto a medium according to a first image data section and a second image data section of image data. A moving amount sensor detects a moving amount of the liquid droplet discharging apparatus. A switcher switches from the first image data section to the second image data section based on the detected moving amount.

This specification further describes an improved liquid droplet discharging method for discharging a liquid droplet onto a medium. The liquid droplet discharging method includes discharging a liquid droplet onto a medium according to a first image data section and a second image data section, detecting a moving amount of a liquid droplet discharging apparatus, and switching from the first image data section to the second image data section based on the detected moving amount.

This specification further describes an improved non-transitory computer readable medium for performing the liquid droplet discharging method described above.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1A:
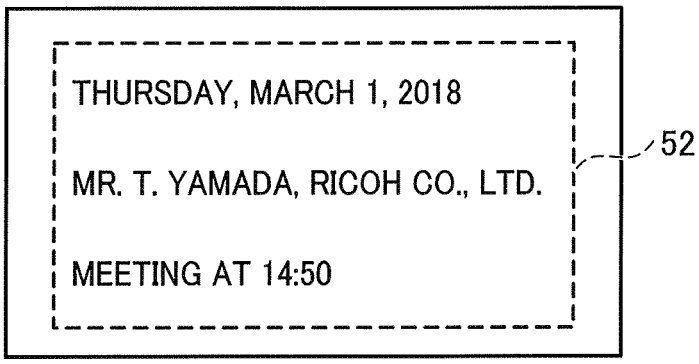
FIG. 1A is a plan view of an image.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION OF THE DISCLOSURE

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Referring now to the drawings, wherein like reference numerals designate identical or corresponding parts throughout the several views, particularly to FIG. 1A, a handy mobile printer (HMP) according to a first embodiment is explained.

Referring to drawings, a description is provided of a construction of a liquid droplet discharging apparatus and a liquid droplet discharging method performed by the liquid droplet discharging apparatus.

A description is provided of a first embodiment of the present disclosure.

A description is provided of a summary of a method for printing performed by a comparative handy mobile printer (HMP) 20C.

First, a description is provided of an operation of the comparative HMP 20C.

FIGS. 1A, 1B, 1C, and 1D schematically illustrate one example of the method for printing performed by the comparative HMP 20C. FIG. 1A is a plan view of an image 52. As illustrated in FIG. 1A, the image 52 includes three character strings that construct a single image.

Figure 1B:
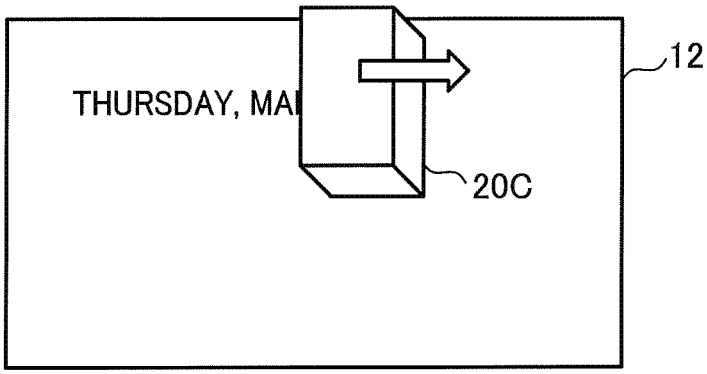
FIG. 1B is a perspective view of a print medium and a comparative handy mobile printer (HMP) moved rightward.
Figure 1C:
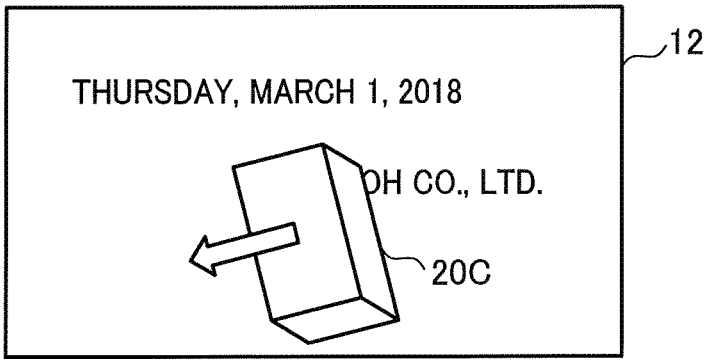
FIG. 1C is a perspective view of the print medium and the comparative HMP depicted in FIG. 1B moved left downward.
Figure 1D:
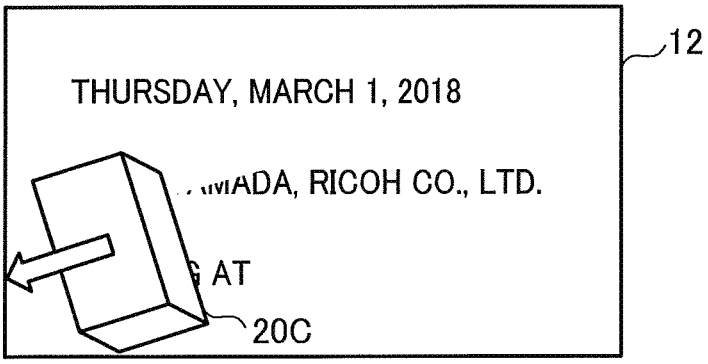
FIG. 1D is a perspective view of the print medium and the comparative HMP depicted in FIG. 1B moved left downward farther.

FIGS. 1B, 1C, and 1D illustrate a print medium 12 and the comparative HMP 20C moved by a user to print the image 52 on the print medium 12. FIG. 1B is a perspective view of the print medium 12 and the comparative HMP 20C moved rightward. When the user moves the comparative HMP 20C to a right end of the print medium 12, the user moves the comparative HMP 20C left downward as illustrated in FIGS. 1C and 1D. FIG. 1C is a perspective view of the print medium 12 and the comparative HMP 20C moved left downward. FIG. 1D is a perspective view of the print medium 12 and the comparative HMP 20C moved left downward farther.

As illustrated in FIGS. 1C and 1D, even if the user intends to print each of the three character strings of the image 52, the user may fail to move the comparative HMP 20C horizontally. Accordingly, a part of the image 52 may be produced obliquely along a trajectory of the comparative HMP 20C. The user may move the comparative HMP 20C repeatedly to print a remaining part of the image 52 or may shift the comparative HMP 20C from an appropriate scanning direction, degrading image quality.

A description is provided of a method for printing performed by the comparative HMP 20C according to separate image sections, that is, a first image section 52*a*, a second image section 52*b*, and a third image section 52*c* of the image 52.

Figure 2A:
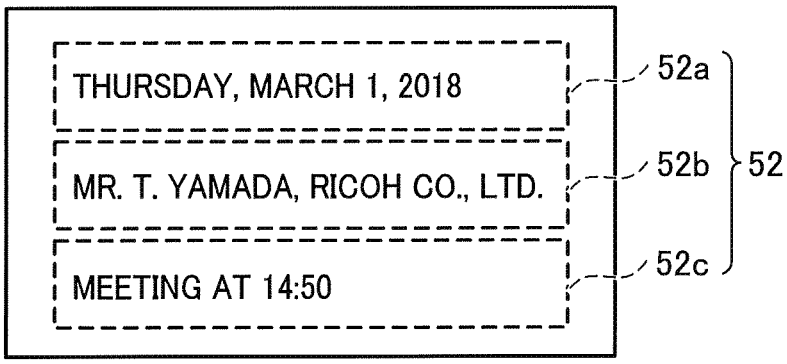
FIG. 2A is a plan view of the image depicted in FIG. 1A.

FIGS. 2A, 2B, 2C, and 2D schematically illustrate the method for printing performed by the comparative HMP 20C according to the first image section 52*a*, the second image section 52*b*, and the third image section 52*c* into which the image 52 is divided. FIG. 2A is a plan view of the image 52. The image 52 depicted in FIG. 2A is formed according to single document data. The image 52 is divided into the plurality of image sections, that is, the first image section 52*a*, the second image section 52*b*, and the third image section 52*c* to be printed on the single print medium 12. FIG. 2A illustrates the image 52 divided into the three image sections, that is, the first image section 52*a*, the second image section 52*b*, and the third image section 52*c*, serving as the three character strings, respectively.

Figure 2B:
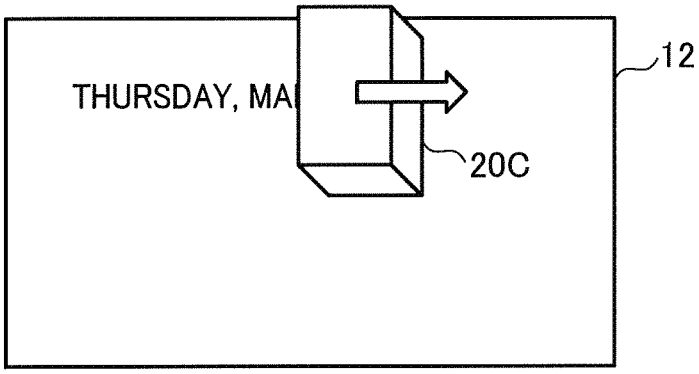
FIG. 2B is a perspective view of the print medium and the comparative HMP depicted in FIG. 1B moved rightward to print a first image section of the image.
Figure 2C:
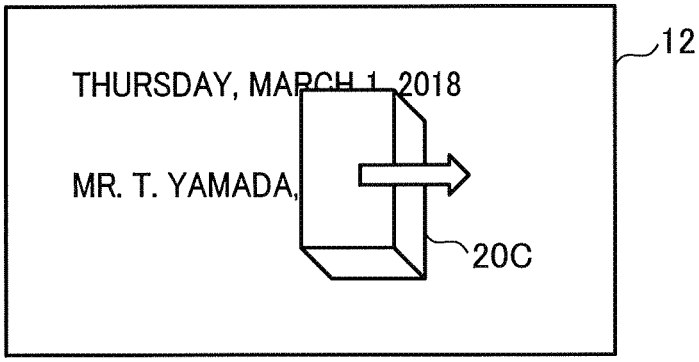
FIG. 2C is a perspective view of the print medium and the comparative HMP depicted in FIG. 1B moved rightward to print a second image section of the image.
Figure 2D:
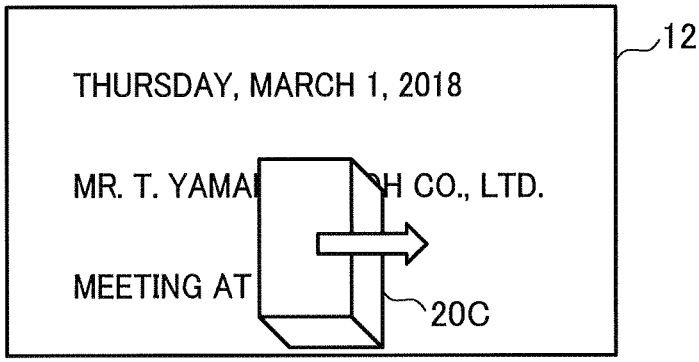
FIG. 2D is a perspective view of the print medium and the comparative HMP depicted in FIG. 1B moved rightward to print a third image section of the image.

As illustrated in FIG. 2B, in order to print the first image section 52*a*, as the first character string, on the print medium 12, the user sends a first image data section to be formed into the first image section 52*a* from an image data output device described below to the comparative HMP 20C. The user presses a print start button on the comparative HMP 20C to start scanning the print medium 12 to print the first image section 52*a* as the first character string on a first line on the print medium 12. When the comparative HMP 20C finishes scanning the print medium 12 to print the first image section 52*a*, as illustrated in FIG. 2C, the user sends a second image data section to be formed into the second image section 52*b* from the image data output device to the comparative HMP 20C. The user presses the print start button on the comparative HMP 20C to start scanning the print medium 12 to print the second image section 52*b* as the second character string on a second line on the print medium 12. When the comparative HMP 20C finishes scanning the print medium 12 to print the second image section 52*b*, as illustrated in FIG. 2D, the user sends a third image data section to be formed into the third image section 52*c* from the image data output device to the comparative HMP 20C. The user presses the print start button on the comparative HMP 20C to start scanning the print medium 12 to print the third image section 52*c* as the third character string on a third line on the print medium 12.

As illustrated in FIGS. 2B, 2C, and 2D, since the user readily moves the comparative HMP 20C horizontally rightward in one direction, the comparative HMP 20C scans the print medium 12 three times to print the first image section 52*a*, the second image section 52*b*, and the third image section 52*c* on the first line, the second line, and the third line on the print medium 12, respectively. Additionally, the comparative HMP 20C does not deviate from the first line, the second line, and the third line on the print medium 12 easily, reducing degradation of image quality. However, whenever the comparative HMP 20C finishes printing one of the first image section 52*a* and the second image section 52*b*, the user is bothered to send image data to be formed into next one of the second image section 52*b* and the third image section 52*c* from the image data output device to the comparative HMP 20C and press the print start button. Even if the image data output device collectively sends the first image data section, the second image data section, and the third image data section to be formed into the first image section 52*a*, the second image section 52*b*, and the third image section 52*c*, respectively, the user is bothered to press the print start button to switch between the first image data section, the second image data section, and the third image data section.

A description is provided of a method for starting printing performed by a handy mobile printer (HMP) 20 according to the first embodiment to print the separate image sections, that is, the first image section 52*a*, the second image section 52*b*, and the third image section 52*c*, of the image 52.

To address the above-described circumstances of the comparative HMP 20C, when printing the plurality of image sections (e.g., the first image section 52*a*, the second image section 52*b*, and the third image section 52*c*) continuously, the HMP 20 according to the first embodiment detects switching performed by the user to cause the HMP 20 to perform a particular motion, cancels or interrupts a current printing of one of the first image section 52*a*, the second image section 52*b*, and the third image section 52*c*, and switches to a next printing of next one of the second image section 52*b* and the third image section 52*c*, thus eliminating an inconvenient operation by the user to start the next printing whenever the current printing finishes.

Figure 3A:
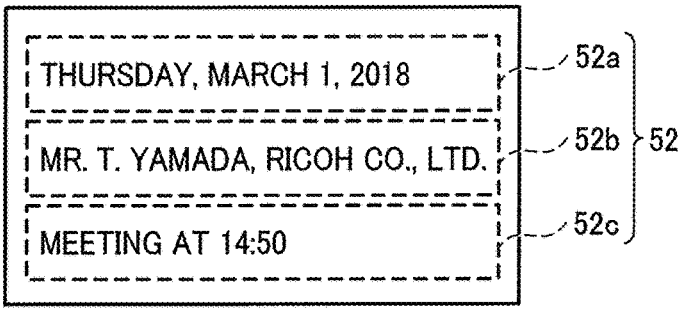
FIG. 3A is a plan view of the image depicted in FIG. 1A.

FIGS. 3A, 3B, 3C, 3D, and 3E illustrate one example of the method for starting printing each of the first image section 52*a*, the second image section 52*b*, and the third image section 52*c* of the image 52 without the inconvenient operation by the user. FIG. 3A is a plan view of the image 52 as one example. The image 52 depicted in FIG. 3A is identical to the image 52 depicted in FIG. 2A.

Figure 3B:
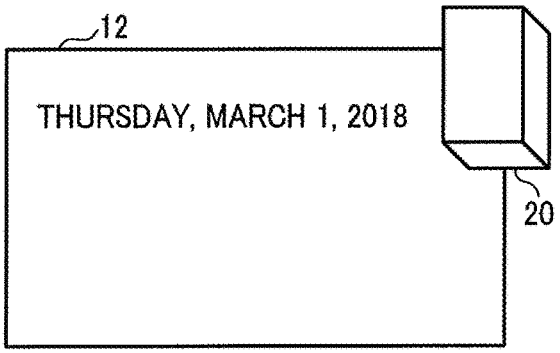
FIG. 3B is a perspective view of an HMP that prints the first image section of the image.
Figure 3C:
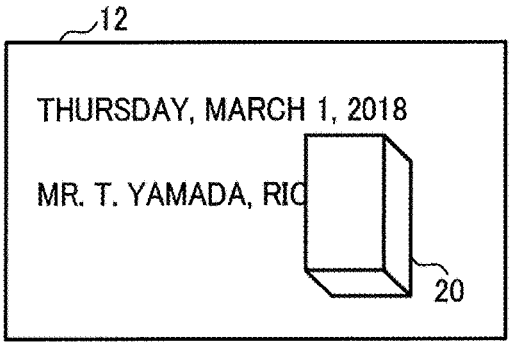
FIG. 3C is a perspective view of the print medium and the HMP depicted in FIG. 3B moved rightward to print the second image section of the image.

Referring to FIGS. 3B and 3C, a description is provided of switching between the first image section 52*a*, the second image section 52*b*, and the third image section 52*c* by lifting the HMP 20.

FIG. 3B illustrates the HMP 20 that prints the first image section 52*a* as the first character string. While the HMP 20 prints the first image section 52*a* or when the HMP 20 finishes printing the first image section 52*a*, the user lifts the HMP 20 from the print medium 12. When the HMP 20 detects lifting from the print medium 12, the HMP 20 starts printing a next image section, that is, the second image section 52*b*. As illustrated in FIG. 3C, when the user moves the HMP 20 to a print start position of the second image section 52*b*, the HMP 20 starts printing the second image section 52*b*.

Figure 3D:
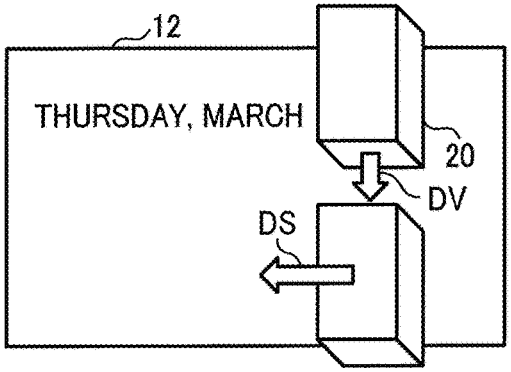
FIG. 3D is a perspective view of the print medium and the HMP depicted in FIG. 3B moved downward and leftward to print the second image section of the image.
Figure 3E:
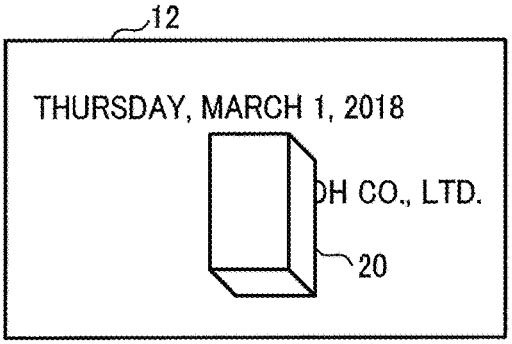
FIG. 3E is a perspective view of the print medium and the HMP depicted in FIG. 3B moved leftward to print the second image section of the image.

Referring to FIGS. 3D and 3E, a description is provided of switching between the first image section 52*a*, the second image section 52*b*, and the third image section 52*c* by moving (e.g., returning) the HMP 20 to start a new line as described below.

FIG. 3D illustrates the HMP 20 that prints the first image section 52*a*. While the HMP 20 prints the first image section 52*a* or when the HMP 20 finishes printing the first image section 52*a*, the user moves the HMP 20 vertically for a predetermined amount or greater. For example, the predetermined amount is an alignment length for which a plurality of nozzles of the HMP 20 is aligned. When the HMP 20 detects vertical movement for the predetermined amount or greater in a vertical direction DV perpendicular to a scanning direction DS in FIG. 3D, the HMP 20 starts printing the next image section (e.g., the second image section 52*b*) as illustrated in FIG. 3E.

As described above, the HMP 20 according to the first embodiment detects switching performed by the user to cause the HMP 20 to perform a particular motion, cancels or interrupts a current printing of one of the first image section 52*a*, the second image section 52*b*, and the third image section 52*c*, and switches to a next printing of next one of the second image section 52*b* and the third image section 52*c*, thus eliminating an operation by the user to start the next printing whenever the current printing finishes.

A description is provided of definition of terms used in the present disclosure.

A term "a posture of the HMP 20" serving as a liquid droplet discharging apparatus defines a posture of the HMP 20 that protrudes beyond the print medium 12 or moves to a position where the HMP 20 is spaced apart from the print medium 12 with an increased distance therebetween. For example, the HMP 20 lifted from the print medium 12 is detected.

A term "a position of the HMP 20" serving as a liquid droplet discharging apparatus defines a position to which the HMP 20 is estimated to move to print the next one of the second image section 52*b* and the third image section 52*c*. The HMP 20 moved to a position outside one of the first image section 52*a*, the second image section 52*b*, and the third image section 52*c*, which is currently printed is detected. In other words, the HMP 20 moved to a position where the HMP 20 overlaps the next one of the second image section 52*b* and the third image section 52*c* is detected. For example, the HMP 20 moves to a position where the HMP 20 starts a new line as described below.

A term "a liquid droplet discharging apparatus" defines an apparatus that discharges a discharged substance capable of being discharged at least as liquid temporarily onto a target position. Although image formation with ink is widely employed, the discharged substance is not limited to ink. Usage of the discharged substance is not limited to image formation.

A description is provided of image formation by the HMP 20.

Figure 4A:
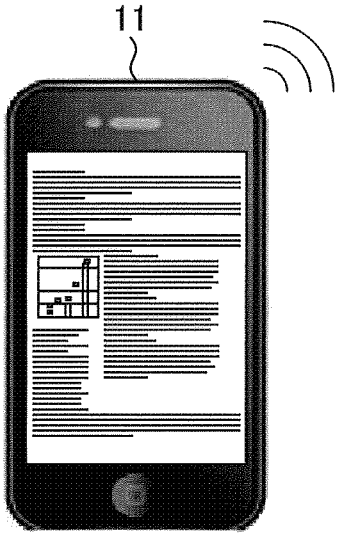
FIG. 4A is a perspective view of an image data output device.
Figure 4B:
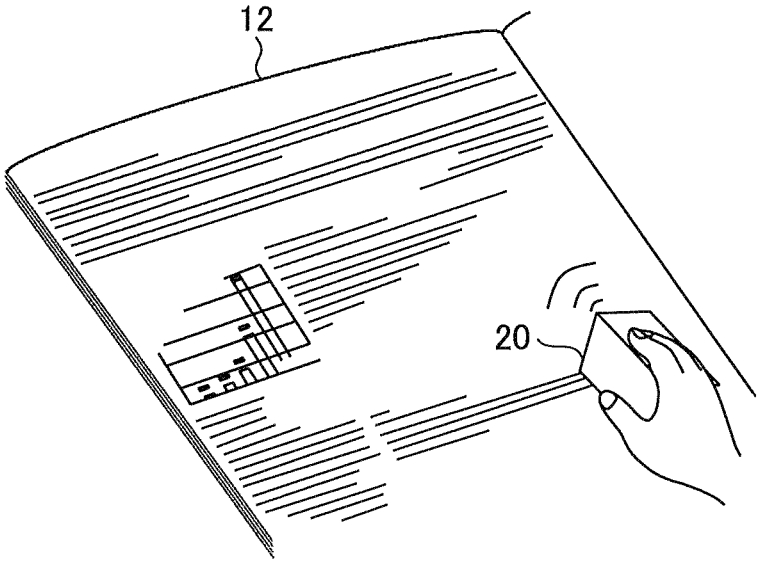
FIG. 4B is a perspective view of a handy mobile printer (HMP) according to an embodiment of the present disclosure and a print medium.

FIGS. 4A and 4B schematically illustrate image formation by the HMP 20 as one example. FIG. 4A is a perspective view of an image data output device 11. FIG. 4B is a perspective view of the HMP 20 and the print medium 12. As illustrated in FIGS. 4A and 4B, the HIMP 20 receives image data sent from the image data output device 11 such as a smartphone and a personal computer (PC). The user grasps the HMP 20 and moves the HMP 20 manually and freely to scan the print medium 12 (e.g., a standard size sheet and a notebook) such that the HMP 20 is not lifted above the print medium 12.

As described below, the HMP 20 includes a navigation sensor 30 and a gyroscope 31 that detect the position of the HMP 20. When the HMP 20 reaches a target discharging position, nozzles 61 described below of the HMP 20 discharge ink in an appropriate color at the target discharging position. Since the HMP 20 masks a position where the nozzles 61 have already discharged ink and therefore do not need to discharge ink, the user moves the HMP 20 to scan the print medium 12 in an arbitrary direction. Thus, the HMP 20 forms an image on the print medium 12.

It is preferable that the HMP 20 is not lifted from the print medium 12 to allow the navigation sensor 30 to detect a moving amount of the HMP 20 that moves by using reflected light reflected by the print medium 12. If the HMP 20 is lifted from the print medium 12, the navigation sensor 30 does not detect the reflected light and therefore does not detect the moving amount of the HMP 20. If the navigation sensor 30 protrudes beyond the print medium 12, the navigation sensor 30 may not detect the reflected light due to the thickness of the print medium 12 or may detect the reflected light erroneously. To address those circumstances, the navigation sensor 30 preferably moves over and scans the print medium 12.

A description is provided of a construction of the HMP 20.

Figure 5:
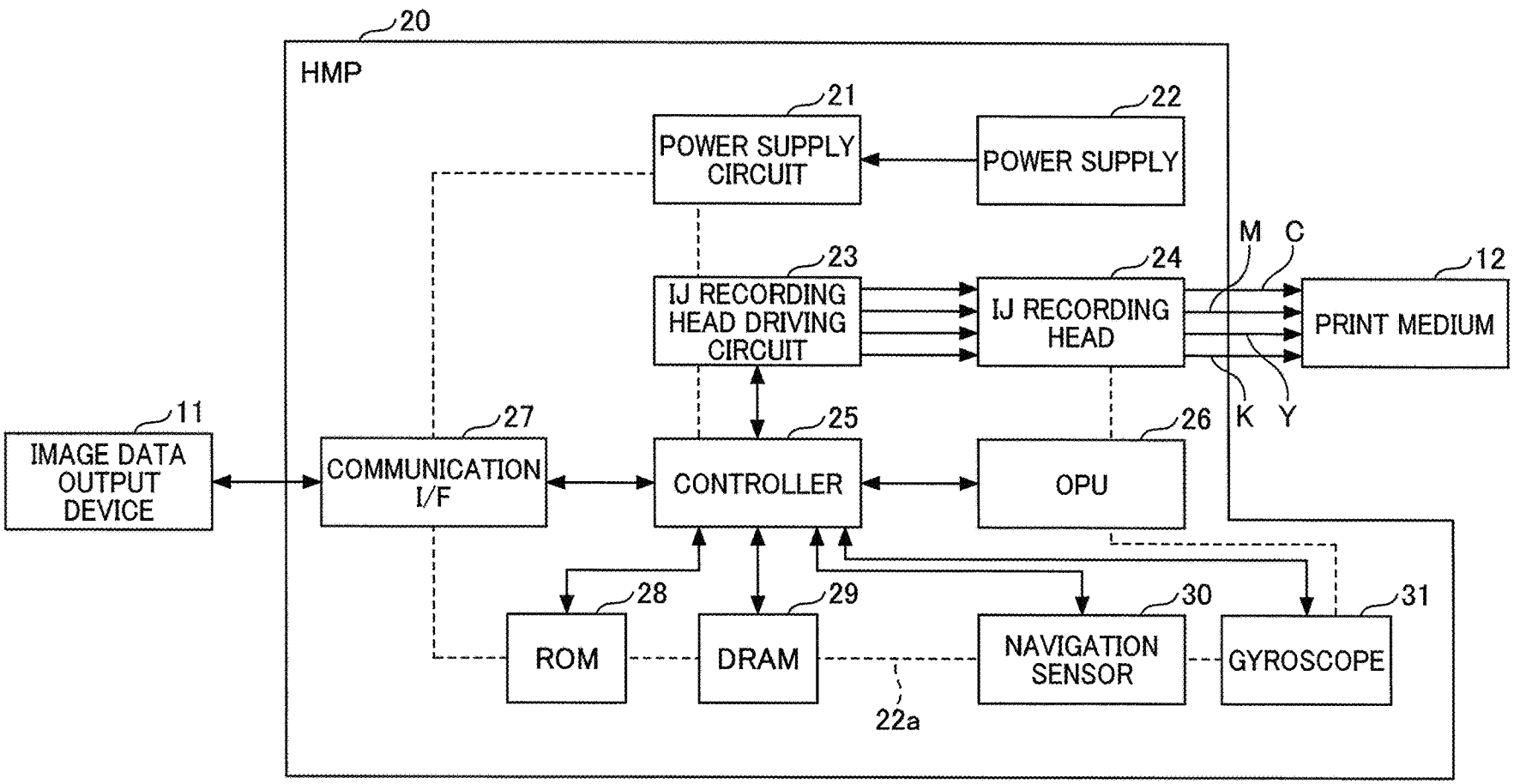
FIG. 5 is a block diagram of a hardware configuration of the HMP depicted in FIG. 4B.

FIG. 5 is a block diagram of a hardware configuration of the HMP 20 as one example. The HMP 20 is one example of a liquid droplet discharging apparatus or an image forming apparatus that forms an image on the print medium 12. A controller 25 (e.g., a processor) controls an entire operation of the HMP 20. The controller 25 is electrically connected to a communication interface (I/F) 27, an inkjet (IJ) recording head driving circuit 23, an operation panel unit (OPU) 26, a read only memory (ROM) 28, a dynamic random access memory (DRAM) 29, the navigation sensor 30, and the gyroscope 31. Since the HMP 20 is driven by power, the HMP 20 includes a power supply 22 and a power supply circuit 21. Power generated by the power supply circuit 21 is supplied to the communication I/F 27, the IJ recording head driving circuit 23, the OPU 26, the ROM 28, the DRAM 29, an inkjet (IJ) recording head 24, the controller 25, the navigation sensor 30, and the gyroscope 31 through a wiring 22*a* marked in a dotted line and the like.

A battery is used as the power supply 22 mainly. Alternatively, a solar battery, a commercial power supply (e.g., an alternating current power supply), a fuel cell, or the like may be used as the power supply 22. The power supply circuit 21 distributes power supplied from the power supply 22 to components of the HMP 20. The power supply circuit 21 increases and decreases the voltage of the power supply 22 to a voltage appropriate for each of the components of the HMP 20. If the power supply 22 is a chargeable battery, the power supply circuit 21 detects connection to the alternating current power supply and connects the power supply 22 to a charging circuit of the battery, causing the charging circuit to charge the power supply 22.

The communication I/F 27 receives image data from the image data output device 11 such as the smartphone and the PC. For example, the communication I/F 27 is a communication device that conforms to communications standards such as wireless local area network (LAN), Bluetooth®, near field communication (NFC), infrared communication, visible light communication, 3G for mobile telecommunications, and long term evolution (LTE). In addition to the wireless communications described above, the communication I/F 27 may be a communication device that conforms to cable communications using wired LAN, a universal serial bus (USB) cable, or the like.

The ROM 28 stores a program executed by a central processing unit (CPU) 33 described below, firmware that controls hardware of the HMP 20, driving waveform data that drives the IJ recording head 24 (e.g., data that restricts change in voltage to discharge liquid droplets), default setting data of the HMP 20, and the like.

The DRAM 29 stores image data received by the communication I/F 27 and the program and the firmware extracted from the ROM 28. Hence, the CPU 33 is used as a working memory to execute the program and the firmware. The HMP 20 may incorporate a plurality of CPUs 33.

The navigation sensor 30 detects the moving amount of the HMP 20 per predetermined cyclic time. For example, the navigation sensor 30 includes a light source such as a light emitting diode (LED) and a laser and an imaging sensor that captures the print medium 12. As the HMP 20 scans the print medium 12, the navigation sensor 30 detects or captures minute edges of the print medium 12 successively and analyzes a distance between the edges, thus obtaining the moving amount of the HMP 20. According to this embodiment, the single navigation sensor 30 is mounted on a bottom face of the HMP 20. Generally, two navigation sensors 30 are mounted on the bottom face of the HMP 20. However, some descriptions are provided below with reference to the HMP 20 incorporating the two navigation sensors 30. Alternatively, the navigation sensor 30 may be a multi-axis accelerometer. In this case, the moving amount of the HMP 20 may be detected by the accelerometer only.

The gyroscope 31 is a sensor that detects the angular velocity of the HMP 20 when the HMP 20 rotates about an axis perpendicular at least to the print medium 12 at a yaw angle. The gyroscope 31 preferably detects the pitch angle and the roll angle of the HMP 20 to detect lifting of the HMP 20. A detailed description of a configuration of the gyroscope 31 is deferred.

The OPU 26 includes an LED that displays the status of the HMP 20 and a switch, a button, or a key with which the user instructs image formation to the HMP 20. However, the OPU 26 may have other configurations. For example, the OPU 26 may include at least one of a liquid crystal display, a touch panel, and a voice input device.

The IJ recording head driving circuit 23, using the driving waveform data described above, generates a driving waveform (e.g., a voltage) that drives the IJ recording head 24. The IJ recording head driving circuit 23 generates the driving waveform according to the size or the like of an ink droplet.

The IJ recording head 24 discharges ink (e.g., an ink droplet). FIG. 5 illustrates the U recording head 24 that discharges ink in four colors, that is, cyan (C), magenta (M), yellow (Y), and black (K). Alternatively, the IJ recording head 24 may discharge ink in a single color or five colors or more. The plurality of nozzles 61 illustrated below, serving as a discharging portion that discharges ink, is aligned in a line or two lines or more per color. The nozzles 61 discharge ink in a piezoelectric method, a thermal method, or other methods. The IJ recording head 24 is a functional component to discharge or jet liquid from the nozzles 61. Discharged liquid is not limited to particular liquid as long as the liquid has a viscosity or surface tension that allows the liquid to be discharged from the IJ recording head 24. However, preferably, the viscosity of the liquid is not greater than 30 mPa·s under ambient temperature and ambient pressure or by heating or cooling. Examples of the liquid include a solution, a suspension, or an emulsion that contains, for example, a solvent such as water and an organic solvent, a colorant such as dye and pigment, a functional material such as a polymerizable compound, a resin, and a surfactant, a biocompatible material such as deoxyribonucleic acid (DNA), amino acid, protein, and calcium, or an edible material such as a natural colorant. Such a solution, a suspension, and an emulsion are used for, e.g., inkjet ink, a surface treatment solution, a liquid for forming components of an electronic element and a light-emitting element or a resist pattern of an electronic circuit, or a material solution for three-dimensional fabrication.

The controller 25 includes the CPU 33 as described below and controls the HMP 20 entirely. Based on the moving amount of the HMP 20 detected by the navigation sensor 30 and the angular velocity of the HMP 20 detected by the gyroscope 31, the controller 25 performs determination of the position of each of the nozzles 61 of the IJ recording head 24, determination of an image to be formed according to the determined position of each of the nozzles 61, determination of activation of the nozzles 61 as described below, and the like.

A detailed description of a configuration of the controller 25 is provided below.

Figure 6:
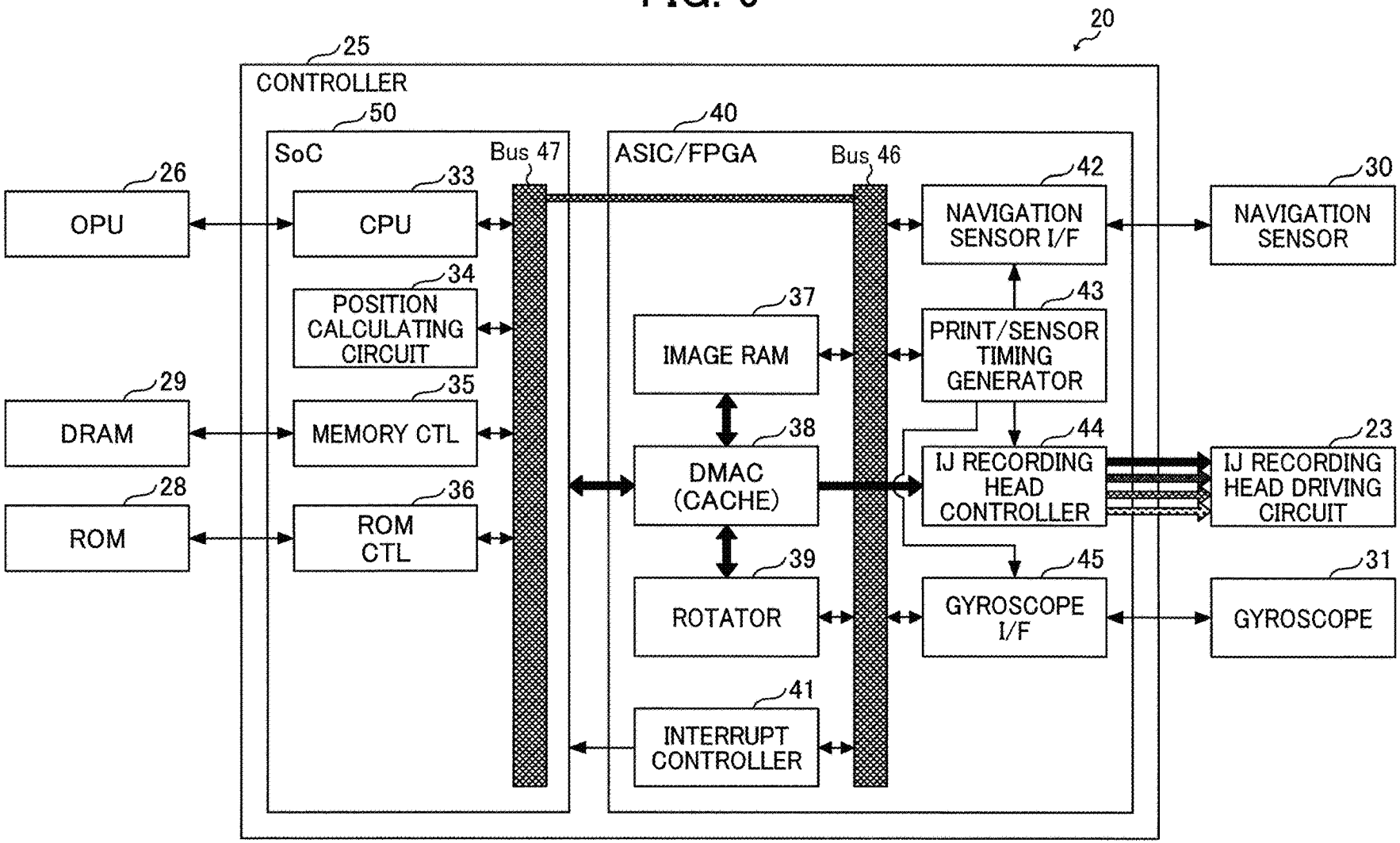
FIG. 6 is a block diagram of the HMP depicted in FIG. 5, illustrating a configuration of a controller incorporated therein.

FIG. 6 is a block diagram of the HMP 20, illustrating the configuration of the controller 25 as one example. The controller 25 includes a system-on-a-chip (SoC) 50 and an application specific integrated circuit (ASIC)/field-programmable gate array (FPGA) 40. The SoC 50 communicates with the ASIC/FPGA 40 through buses 46 and 47. The ASIC/FPGA 40 is designed by an implementation technology of either ASIC or FPGA. Alternatively, the ASIC/FPGA 40 may be replaced with a device designed by implementation technologies other than ASIC and FPGA. The SoC 50 and the ASIC/FPGA 40 may not be separate chips, respectively, and may be combined into a single chip and a single substrate. Alternatively, the SoC 50 and the ASIC/FPGA 40 may be three or more chips and substrates.

The SoC 50 includes the CPU 33, a position calculating circuit 34, a memory controller (CTL) 35, and a ROM controller (CTL) 36, which are connected to each other through the bus 47. Alternatively, the SoC 50 may include other components.

The ASIC/FPGA 40 includes an image random access memory (RAM) 37, a direct memory access controller (DMAC) 38, a rotator 39, an interrupt controller 41, a navigation sensor interface (IF) 42, a print/sensor timing generator 43, an inkjet (U) recording head controller 44, and a gyroscope interface (I/F) 45, which are connected to each other through the bus 46. Alternatively, the ASIC/FPGA 40 may include other components.

The CPU 33 executes firmware (e.g., a program) and the like extracted from the ROM 28 to the DRAM 29 and controls operation of the position calculating circuit 34, the memory CTL 35, and the ROM CTL 36, which are disposed inside the SoC 50. The CPU 33 also controls operation of the image RANI 37, the DMAC 38, the rotator 39, the interrupt controller 41, the navigation sensor IF 42, the print/sensor timing generator 43, the IJ recording head controller 44, the gyroscope I/F 45, and the like, which are disposed inside the ASIC/FPGA 40.

The position calculating circuit 34 calculates the position (e.g., coordinate information) of the HMP 20 based on the moving amount of the HMP 20 per sampling cycle, which is detected by the navigation sensor 30 and the angular velocity of the HMP 20 per sampling cycle, which is detected by the gyroscope 31. Although the position of the HMP 20 is the position of the nozzle 61 exactly, if the position of the navigation sensor 30 is identified, the position calculating circuit 34 calculates the position of the nozzle 61. According to this embodiment, the position of the navigation sensor 30 is identified as the position of a navigation sensor S0 described below unless otherwise noted. The position calculating circuit 34 calculates a target discharging position. Alternatively, the CPU 33 may attain the position calculating circuit 34 on software basis.

The position calculating circuit 34 calculates the position of the navigation sensor 30 based on a predetermined start point as described below, for example, a default position of the HMP 20 when image formation starts. The position calculating circuit 34 estimates a moving direction and acceleration of the HMP 20 based on a difference between a past position and a last position, thus estimating a position of the navigation sensor 30 when the nozzle 61 discharges ink next time, for example. Thus, the nozzle 61 discharges ink while suppressing delay in discharging ink after the user moves the HMP 20 to scan the print medium 12.

The memory CTL 35 is an interface with the DRAM 29. The memory CTL 35 requests the DRAM 29 for data, sends obtained firmware to the CPU 33, and sends obtained image data to the ASIC/FPGA 40.

The ROM CTL 36 is an interface with the ROM 28. The ROM CTL 36 requests the ROM 28 for data and sends the obtained data to the CPU 33 and the ASIC/FPGA 40.

The rotator 39 rotates image data obtained by the DMAC 38 according to conditions of the IJ recording head 24 that discharges ink, for example, the position of the nozzle 61 inside the IJ recording head 24 and inclination of the IJ recording head 24 caused by installation error or the like. The DMAC 38 outputs image data after rotation to the IJ recording head controller 44.

The image RAM 37 temporarily stores the image data obtained by the DMAC 38. That is, the image RAM 37 performs buffering on a certain amount of image data and retrieves the image data according to the position of the HMP 20.

The IJ recording head controller 44 performs dithering and the like on the image data (e.g., bitmap data) and converts the image data into an aggregation of dots that represent an image with the size of the dots. Thus, the image data is converted into data defining the target discharging position of ink and the size of dot. The IJ recording head controller 44 outputs a control signal corresponding to the size of dot to the IJ recording head driving circuit 23. The IJ recording head driving circuit 23, using the driving waveform data described above that corresponds to the control signal, generates a driving waveform (e.g., a voltage) that drives the IJ recording head 24.

The navigation sensor I/F 42 communicates with the navigation sensor 30, receives a moving amount (ΔX, ΔY') described below as information from the navigation sensor 30, and stores the moving amount (ΔX', ΔY') in an internal register.

The print/sensor timing generator 43 notifies a reading time when the navigation sensor I/F 42 and the gyroscope I/F 45 read information and notifies the IJ recording head controller 44 of a driving time. A cycle of the time when the navigation sensor I/F 42 and the gyroscope i/F 45 read information is greater than a cycle of the time when the nozzle 61 discharges ink. The IJ recording head controller 44 determines activation of the nozzle 61. If the IJ recording head controller 44 identifies the target discharging position to which the nozzle 61 is requested to discharge ink, the IJ recording head controller 44 causes the nozzle 61 to discharge ink. Conversely, if the IJ recording head controller 44 does not identify the target discharging position, the IJ recording head controller 44 does not cause the nozzle 61 to discharge ink.

At the reading time defined by the print/sensor timing generator 43, the gyroscope I/F 45 obtains the angular velocity detected by the gyroscope 31 and stores the obtained angular velocity in a resister.

When the interrupt controller 41 detects that the navigation sensor I/F 42 completes communication with the navigation sensor 30, the interrupt controller 41 outputs an interrupt signal that notifies the SoC 50 of completion of communication. Upon receipt of the interrupt signal, the CPU 33 obtains the moving amount (ΔX', ΔY') stored in the internal register of the navigation sensor I/F 42. Additionally, the CPU 33 also notifies a status such as an error. Similarly, with respect to the gyroscope I/F 45, the interrupt controller 41 outputs an interrupt signal that notifies the SoC 50 of completion of communication with the gyroscope 31.

A detailed description is now given of a configuration of the gyroscope 31.

Figure 7:
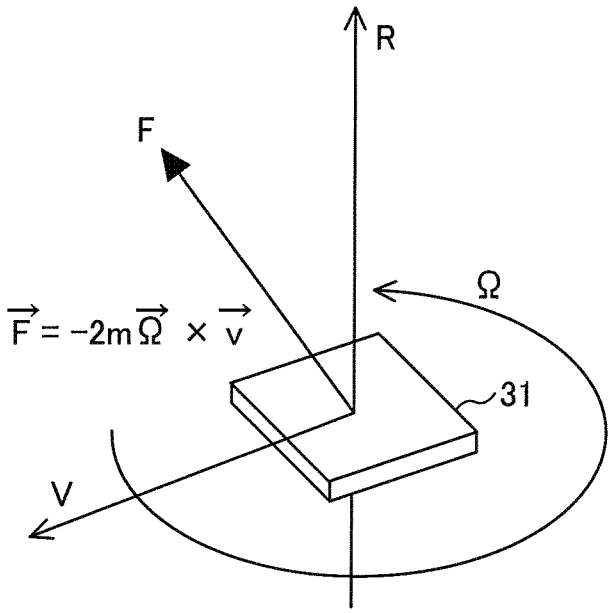
FIG. 7 is a diagram of a gyroscope incorporated in the HMP depicted in FIG. 6.

FIG. 7 is a diagram of the gyroscope 31, illustrating a principle of the gyroscope 31 to detect the angular velocity as one example. As a moving object rotates, a Coriolis force F generates in a direction perpendicular to both a moving direction V of the moving object and a rotation axis R.

In order to move the moving object, the gyroscope 31 vibrates a micro electro mechanical systems (MEMS) element to generate a velocity v (e.g., a vector). As rotation at an angular velocity Ω (e.g., a vector) is applied to the MEMS element having a mass m and vibrating from outside, the Coriolis force F is applied to the MEMS element. The Coriolis force F is defined by a formula (1) below.

$$F=-2\ m\Omega\times v \quad (1)$$

× represents outer product of the vector. As described above, the direction of the Coriolis force F is perpendicular to the moving direction V of the moving object and the rotation axis R. For example, the MEMS element has an electrode that has a comb teeth structure. The gyroscope 31 recognizes a displacement of the moving object by the Coriolis force F as a change in an electrostatic capacity. A signal of the Coriolis force F is amplified in the gyroscope 31, filtered, and then calculated and output into an angular velocity. That is, since the Coriolis force F, the mass m, and the velocity v are known, the angular velocity Ω is retrieved.

FIG. 7 illustrates a configuration of the gyroscope 31 that detects the angular velocity of a single axis. Alternatively, the gyroscope 31 may preferably have a configuration that detects the angular velocity of at least two axes. Accordingly, the gyroscope 31 detects not only the angular velocity of the HMP 20 while the HMP 20 rotates horizontally to the print medium 12 but also the angular velocity of the HMP 20 while the HMP 20 rotates about X-axis horizontally to the print medium 12 or Y-axis vertically to the print medium 12. Thus, the gyroscope 31 detects lifting of the HMP 20.

A description is provided of a configuration of the navigation sensor 30.

Figure 8:
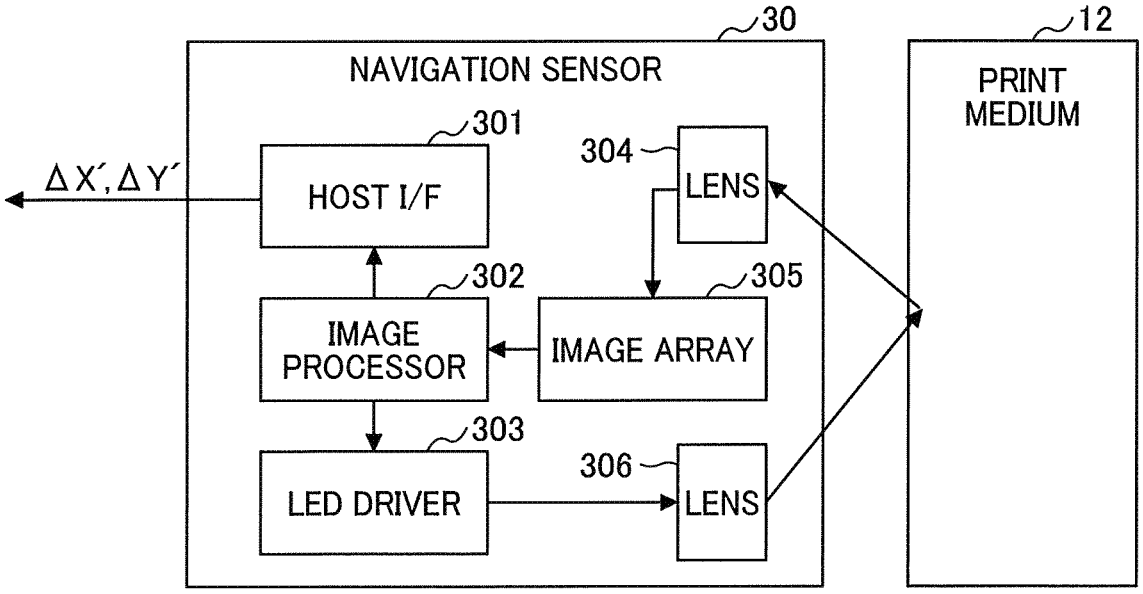
FIG. 8 is a block diagram of a hardware configuration of a navigation sensor incorporated in the HMP depicted in FIG. 6.

FIG. 8 is a block diagram of a hardware configuration of the navigation sensor 30 as one example. FIG. 8 illustrates a surface of paper as the print medium 12. The navigation sensor 30 includes a host interface (I/F) 301, an image processor 302, a light emitting diode (LED) driver 303, two lenses 304 and 306, and an image array 305. The LED driver 303 is a combination of an LED and a control circuit. The LED driver 303 emits LED light according to a command from the image processor 302. The image array 305 receives reflected light, that is, the LED light reflected by the print medium 12, through the lens 304. The two lenses 304 and 306 are disposed at positions where the lenses 304 and 306 are optically focused with respect to the surface of the print medium 12.

The image array 305 includes a photo diode that has sensitivity to a wavelength of the LED light. The image array 305 generates image data based on the received LED light. The image processor 302 obtains the image data and calculates a moving distance, that is, the moving amount (ΔX', ΔY'), of the navigation sensor 30 based on the image data. The image processor 302 outputs the calculated moving distance to the controller 25 through the host I/F 301.

Figure 9:
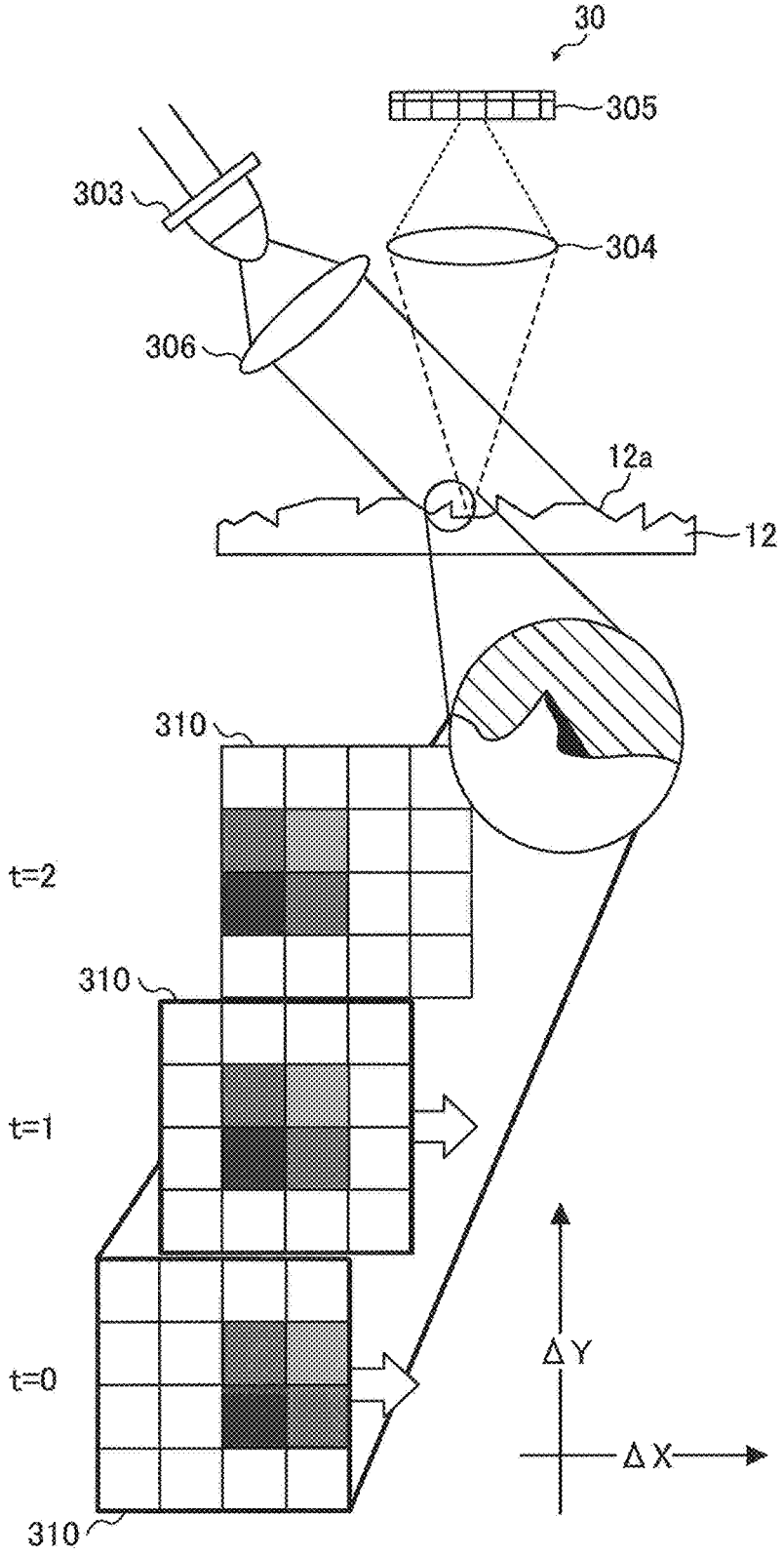
FIG. 9 is a diagram of the navigation sensor depicted in FIG. 8, illustrating a method for detecting a moving amount of the HMP.

The LED used as a light source is advantageous if the print medium 12 has a rough surface, for example, if the print medium 12 is paper. Since the rough surface of the print medium 12 generates a shadow, the image processor 302 calculates the moving distance of the navigation sensor 30 in X-direction and Y-direction precisely based on the shadow as a characteristic mark. Conversely, if the print medium 12 has a smooth surface or is transparent, a semiconductor laser diode (LD) that generates a laser beam is used as a light source. The semiconductor LD forms a stripe pattern or the like on the print medium 12, for example, thus producing a characteristic mark. The image processor 302 calculates the moving distance of the navigation sensor 30 precisely based on the characteristic mark. Referring to FIG. 9, a description is provided of an operation of the navigation sensor 30.

FIG. 9 is a diagram of the navigation sensor 30, illustrating a method for detecting the moving amount of the HMP 20. Light emitted from the LED driver 303 irradiates a surface 12*a* of the print medium 12 through the lens 306. As illustrated in FIG. 9, the surface 12*a* of the print medium 12 has slight asperities of various shapes that create shadows of various shapes.

The image processor 302 receives reflected light through the lens 304 and the image array 305 per predetermined sampling time, thus obtaining image data 310. The image processor 302 converts the image data 310 created as illustrated in FIG. 9 into a matrix per predetermined resolution. For example, the image processor 302 divides the image data 310 into a plurality of rectangular regions. The image processor 302 compares the image data 310 obtained at a previous sampling time with the image data 310 obtained at a present sampling time. The image processor 302 detects the number of the rectangular regions over which the image data 310 moves and calculates the number of the rectangular regions as a moving distance of the HMP 20. If the HMP 20 moves in ΔX-direction in FIG. 9, as the image data 310 at a time t=0 is compared with the image data 310 at a time t=1, an image on a right end under the time t=0 coincides with an image on a center under the time t=1. Since the image moves in −ΔX-direction, the HMP 20 has moved by a single cell in ΔX-direction. The image moves similarly under comparison between the time t=1 and a time t=2.

A description is provided of a configuration of the IJ recording head driving circuit 23.

Figure 10:
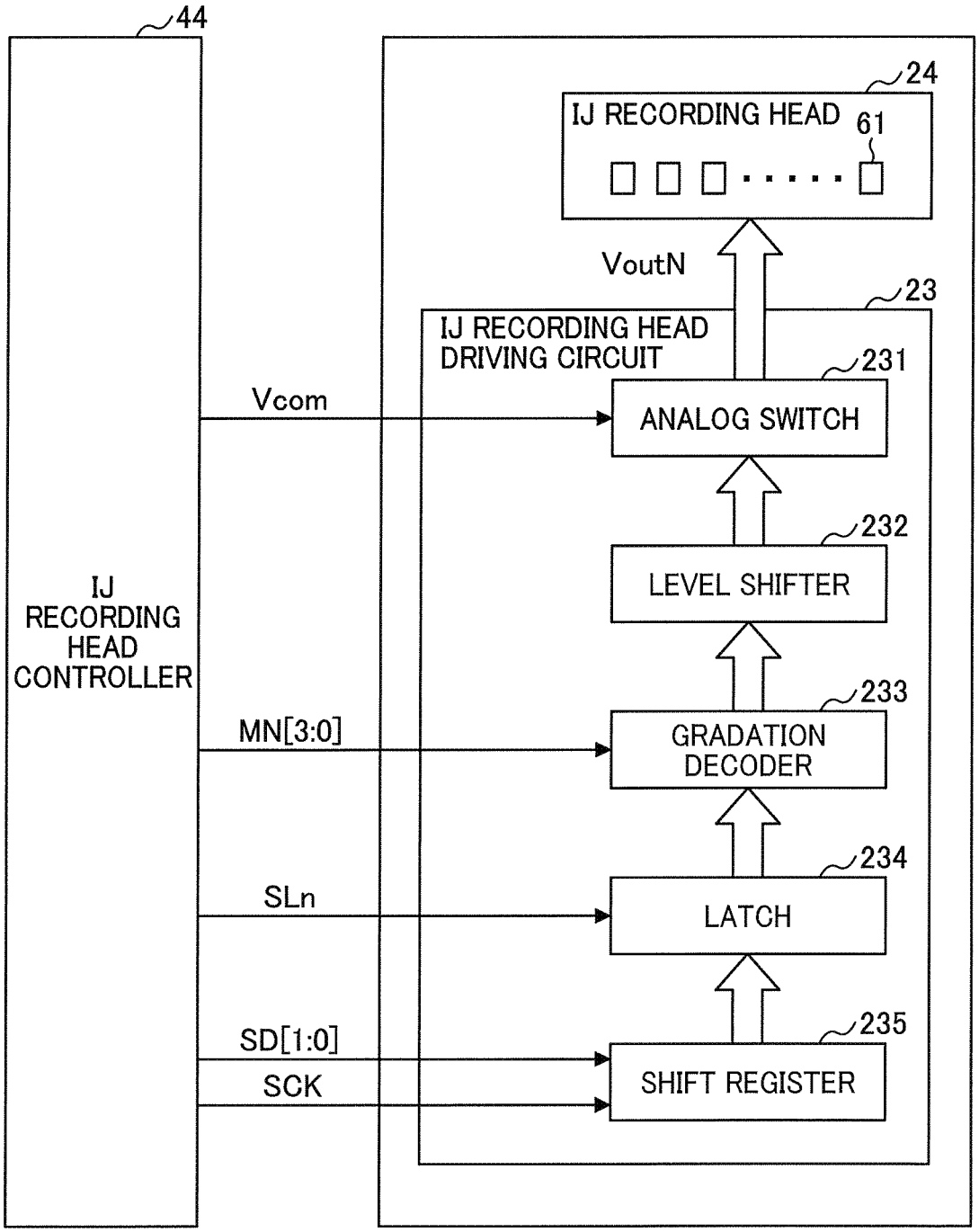
FIG. 10 is a block diagram of an inkjet (IJ) recording head driving circuit incorporated in the HMP depicted in FIG. 6.

FIG. 10 is a block diagram of the IJ recording head driving circuit 23 as one example. The IJ recording head 24 includes the plurality of nozzles 61. Each of the nozzles 61 includes an actuator. The actuator employs the thermal method or the piezoelectric method. In the thermal method, ink inside the nozzle 61 is heated and expanded. The expanded ink is discharged from the nozzle 61 as an ink droplet. In the piezoelectric method, a piezoelectric element presses against a wall of the nozzle 61 to squeeze out ink inside the nozzle 61 as an ink droplet.

The IJ recording head driving circuit 23 includes an analog switch 231, a level shifter 232, a gradation decoder 233, a latch 234, and a shift register 235. The IJ recording head controller 44 transfers image data SD as serial data corresponding to the number of the nozzles 61 (e.g., the actuators) of the IJ recording head 24 to the shift register 235 of the IJ recording head driving circuit 23 through an image data transfer clock SCK.

When the transfer finishes, the IJ recording head controller 44 stores each of the image data SD in the latch 234 allocated to each of the nozzles 61 through an image data latch signal SLn.

After latching the image data SD, the IJ recording head controller 44 outputs a head driving waveform Vcom, which causes each of the nozzles 61 to discharge an ink droplet of each gradation value, to the analog switch 231. The IJ recording head controller 44, which sends a head driving mask pattern MN as a gradation control signal to the gradation decoder 233, transits the head driving mask pattern MN such that the head driving mask pattern MN is selected in accordance with a driving waveform time.

The gradation decoder 233 performs logical operation on the gradation control signal and the latched image data. The level shifter 232 increases a logical level voltage signal obtained by logical operation to a voltage level that drives the analog switch 231.

The analog switch 231 receives the increased voltage signal and is turned on and off, thus varying a driving waveform VoutN to be sent to the actuator of the IJ recording head 24 for each of the nozzles 61. The IJ recording head 24 causes the nozzles 61 to discharge ink droplets according to the driving waveform VoutN, forming an image on the print medium 12.

The configuration and operation of the IJ recording head driving circuit 23 illustrated in FIG. 10 are employed by inkjet printers. Alternatively, configurations other than the configuration illustrated in FIG. 10 may be installed in the HMP 20 as long as the configurations discharge ink droplets.

A description is provided of the position of the nozzle 61 of the IJ recording head 24.

Figure 11A:
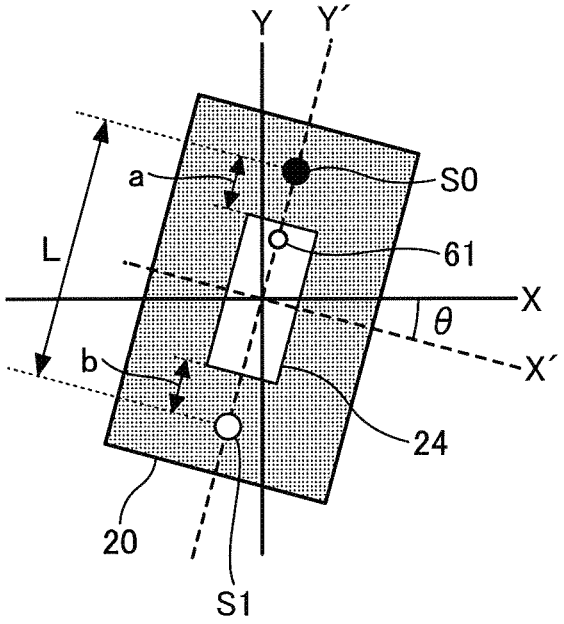
FIG. 11A is a plan view of the HMP depicted in FIG. 4B.
Figure 11B:
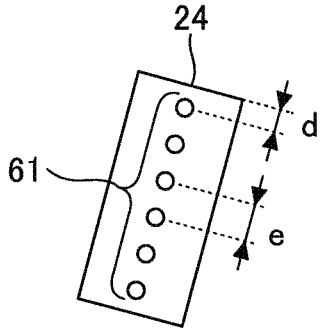
FIG. 11B is a diagram of an IJ recording head incorporated in the HMP depicted in FIG. 11A.

Referring to FIGS. 11A and 11B, a description is provided of the position and the like of the nozzle 61 of the IJ recording head 24.

FIG. 11A is a plan view of the HMP 20 as one example. FIG. 11B is a diagram of the IJ recording head 24 as one example. FIGS. 11A and 11B illustrate an opposed face of the IJ recording head 24, which faces the print medium 12.

According to this embodiment, the HMP 20 includes a single navigation sensor S0. However, FIG. 11A also illustrates another navigation sensor S1 that is provided if the HMP 20 incorporates the two navigation sensors 30 for convenience to illustrate positions of the two navigation sensors 30. If the HMP 20 incorporates the two navigation sensors 30, a distance L (e.g., an interval) is provided between the two navigation sensors S0 and S1. The greater the distance L, the better. As the distance L increases, a minimum rotation angle θ that is detectable decreases, thus reducing error in detecting the position of the HMP 20.

A distance a (e.g., an interval) is provided between the navigation sensor S0 and the U recording head 24. A distance b (e.g., an interval) is provided between the navigation sensor S1 and the IJ recording head 24. The distance a may be equivalent to the distance b. Alternatively, each of the distances a and b may be zero so that the navigation sensors S0 and S1 contact the IJ recording head 24. If the HMP 20 incorporates the single navigation sensor 30, the navigation sensor S0 is situated at an arbitrary position around the IJ recording head 24. Hence, FIG. 11A illustrates the position of the navigation sensor S0 as one example. The navigation sensor S0 situated at the position depicted in FIG. 11A defines the shortened distance a between the navigation sensor S0 and the IJ recording head 24, facilitating downsizing of the bottom face of the HMP 20.

As illustrated in FIG. 11B, a distance d (e.g., an interval) is provided between an edge of the IJ recording head 24 and the nozzle 61 disposed in proximity to the edge of the IJ recording head 24. A distance e (e.g., an interval) is provided between the adjacent nozzles 61. The ROM 28 or the like prestores the distances a, b, d, and e.

If the position calculating circuit 34 or the like calculates the position of the navigation sensor S0, the position calculating circuit 34 calculates the position of the nozzle 61 based on the distances a, b (optionally), d, and e.

A description is provided of the position of the HMP 20 relative to the print medium 12.

Figure 12A:
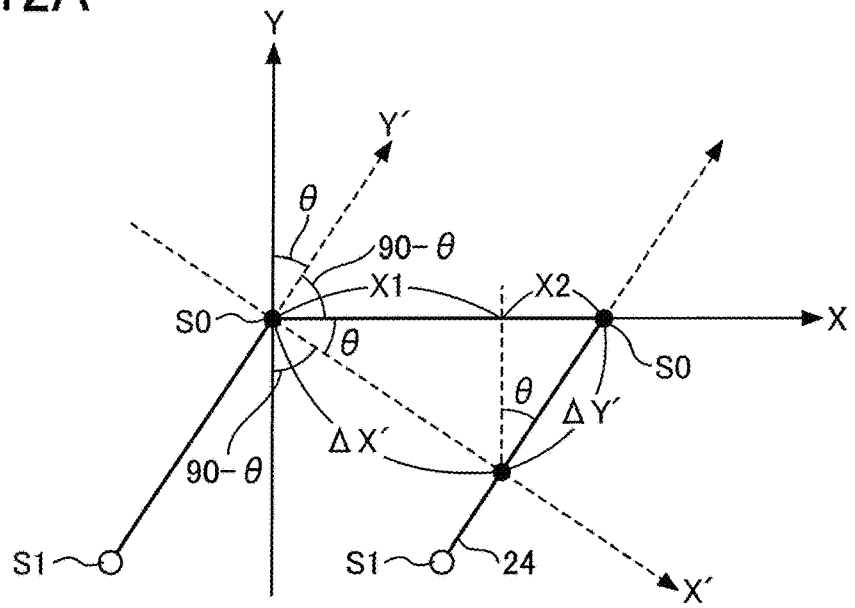
FIG. 12A is a diagram of a coordinate system of the HMP depicted in FIG. 11A for describing X-coordinate.
Figure 12B:
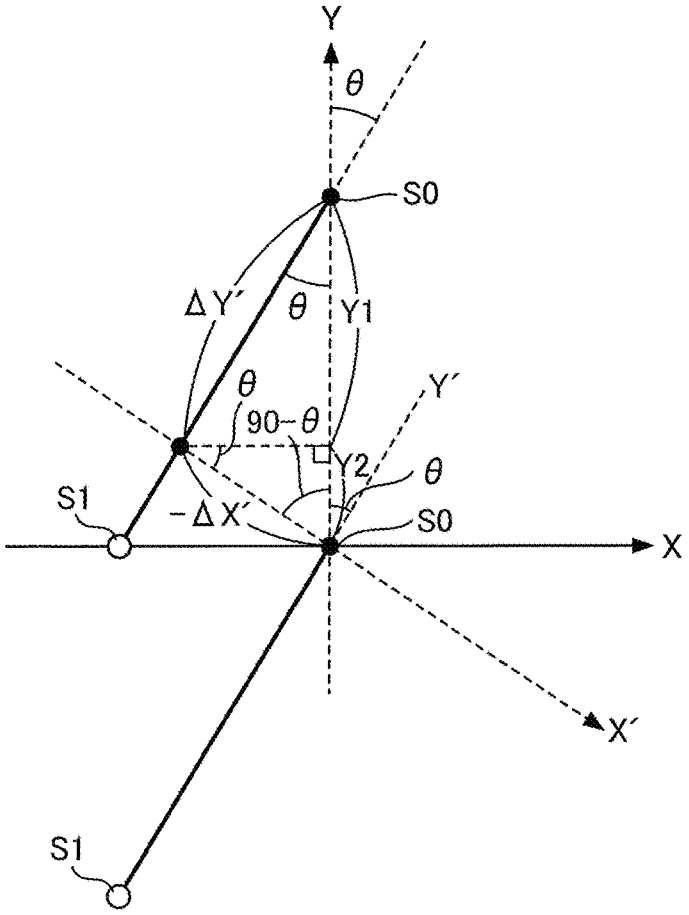
FIG. 12B is a diagram of the coordinate system of the HMP depicted in FIG. 11A for describing Y-coordinate.

FIGS. 12A and 12B illustrate diagrams of a coordinate system of the HMP 20 and a method for calculating the position of the HMIP 20 as one example. According to this embodiment, X-axis defines a direction horizontal to the print medium 12. Y-axis defines a direction perpendicular to the print medium 12. An origin defines the position of the navigation sensor S0 when image formation starts. Such coordinates are hereinafter referred to as print medium coordinates. Conversely, the navigation sensor S0 outputs the moving amount of the HMP 20 on coordinates defined by X'-axis and Y'-axis depicted in FIGS. 12A and 12B. For example, the navigation sensor S0 outputs the moving amount (ΔX', ΔY') on the coordinates in which Y'-axis represents an alignment direction in which the nozzles 61 are aligned and X'-axis represents a direction perpendicular to the Y'-axis.

A description is provided of an example in which the HMP 20 rotates clockwise by the rotation angle θ with respect to the print medium 12 as illustrated in FIG. 12A.

It is difficult for the user to move the HMP 20 to scan the print medium 12 without tilting the HMP 20 relative to the print medium coordinates. Hence, the rotation angle θ may not be zero. If the HMP 20 does not rotate, X-axis is equal to X'-axis and Y-axis is equal to Y'-axis. Conversely, if the HMP 20 rotates by the rotation angle θ relative to the print medium 12, an output of the navigation sensor S0 does not coincide with an actual position of the HMP 20 relative to the print medium 12. The rotation angle θ is positive clockwise in FIGS. 12A and 12B. X-axis and X'-axis are positive rightward in FIGS. 12A and 12B. Y-axis and Y'-axis are positive upward in FIGS. 12A and 12B.

FIG. 12A is a diagram of the coordinate system of the I-IMP 20 for describing X-coordinate as one example. FIG. 12A illustrates a relation between the moving amount (ΔX', ΔY') detected by the navigation sensor S0 and X-axis and Y-axis when the HMP 20 moves in X-direction at the rotation angle θ constantly. If the HMP 20 incorporates the two navigation sensors 30, since the position of the navigation sensor S0 relative to the navigation sensor S1 is fixed, the two navigation sensors S0 and S1 output an identical moving amount. The navigation sensor S0 defines a distance X1+X2 on X-coordinate obtained by adding a distance X2 to a distance X1. The distance X1+X2 is calculated based on the moving amount (ΔX', ΔY') and the rotation angle θ.

FIG. 12B illustrates a relation between the moving amount (ΔX', ΔY') detected by the navigation sensor S0 and X-axis and Y-axis when the HMP 20 moves in Y-direction at the rotation angle θ constantly. The navigation sensor S0 defines a distance Y1+Y2 on Y-coordinate obtained by adding a distance Y2 to a distance Y1. The distance Y1+Y2 is calculated based on a moving amount (−ΔX', ΔY') and the rotation angle θ.

Accordingly, if the HMP 20 moves in X-direction and Y-direction while retaining the rotation angle θ, the moving amount (ΔX', ΔY') output by the navigation sensor S0 is converted on X-axis and Y-axis of the print medium coordinates as defined by formulas (2) and (3) below.

$$X=\Delta X' \cos\theta+\Delta Y' \sin\theta \tag{2}$$

$$Y=-\Delta X' \sin\theta+\Delta Y' \cos\theta \tag{3}$$

A description is provided of detection of the rotation angle θ.

According to this embodiment, the position calculating circuit 34 calculates the rotation angle θ based on an output of the gyroscope 31. The gyroscope 31 outputs the angular velocity μ. The angular velocity μ is defined by a formula (4) below.

$$\mu=d\theta/dt \tag{4}$$

Accordingly, if dt represents a sampling cycle, a rotation angle dθ is defined by a formula (5) below.

$$d\theta=\mu\times dt \tag{5}$$

Accordingly, the rotation angle θ at present defined by a time tin a range of from 0 to N is defined by a formula (6) below.

$$\theta=\sum_{t=0}^{N}\omega i\times dt \tag{6}$$

Thus, the gyroscope 31 calculates the rotation angle θ. As defined by the formulas (2) and (3), the position of the HMP 20 is calculated based on the rotation angle θ. If the position calculating circuit 34 calculates the position of the navigation sensor S0, the position calculating circuit 34 calculates the coordinates of each of the nozzles 61 based on the distances a, b (optionally), d, and e depicted in FIGS. 11A and 11B. Each of a value of X-axis defined by the formula (2) and a value of Y-axis defined by the formula (3) indicates an amount of change per sampling cycle. Accordingly, the position calculating circuit 34 calculates the present position of the HMP 20 by accumulating the values of X-axis and Y-axis.

If the HMP 20 incorporates the two navigation sensors 30, the position calculating circuit 34 calculates the rotation angle θ based on the moving amount ΔX' of the two navigation sensors 30 according to a formula (7) below.

$$D\theta=\arcsin\{(\Delta X'0-\theta X'1)/L\} \tag{7}$$

ΔX' represents a moving amount of the navigation sensor S0 in X'-direction. ΔX'1 represents a moving amount of the navigation sensor S1 in X'-direction. L represents a distance between the navigation sensors S0 and S1.

Figure 13:
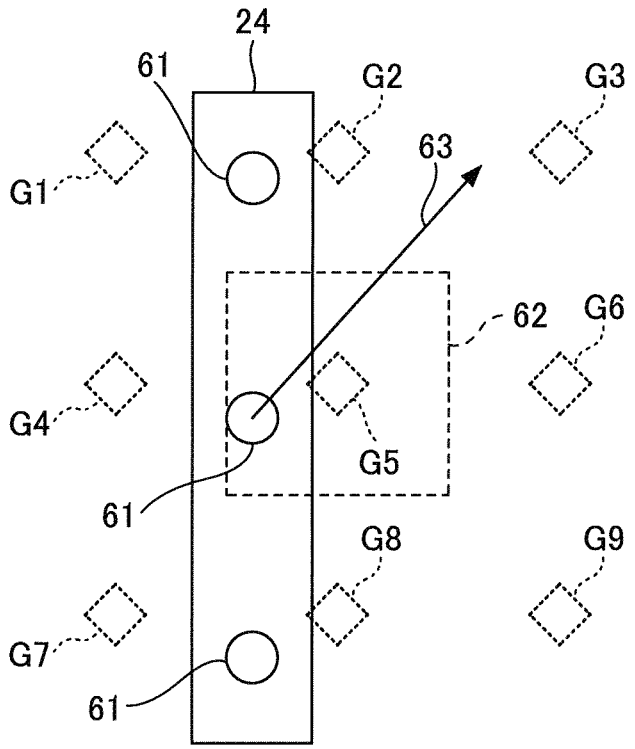
FIG. 13 is a diagram of the IJ recording head depicted in FIG. 11B for describing a relation between a target discharging position and a position of a nozzle incorporated in the IJ recording head.

Referring to FIG. 13, a description is provided of the target discharging position.

FIG. 13 is a diagram of the IJ recording head 24 for describing a relation between the target discharging position and the position of the nozzle 61 as one example. In FIG. 13, target discharging positions G1 to G9 are target positions or pixel positions onto which the nozzles 61 of the HMP 20 discharge ink or pixels are formed. The target discharging positions G1 to G9 are calculated based on the default position of the HMP 20 and resolutions (X dpi, Y dpi) of the HMP 20 in X-direction and Y-direction, respectively.

For example, if the resolution is 300 dpi, the target discharging positions G1 to G9 are set per about 0.084 mm in a longitudinal direction of the IJ recording head 24 and a direction perpendicular to the longitudinal direction of the IJ recording head 24. If pixels onto which ink is to be discharged are at the target discharging positions G1 to G9, the HMP 20 discharges ink.

However, it is practically difficult to capture a time when the nozzles 61 overlap the target discharging positions precisely. To address this circumstance, an allowable error 62 is provided between the target discharging position and the present position of the nozzle 61. When the present position of the nozzle 61 is within the allowable error 62 from the target discharging position, the nozzle 61 discharges ink. Setting of the allowable error 62 is called determining activation of the nozzle 61 or identifying the nozzle 61 that is allowed to discharge ink.

As illustrated with an arrow 63, the HMP 20 monitors the moving direction and acceleration of the nozzle 61, estimating a position of the nozzle 61 where the nozzle 61 discharges ink next time. Accordingly, the position calculating circuit 34 compares the estimated position of the nozzle 61 with the allowable error 62, causing the nozzle 61 to be ready for discharging ink.

A description is provided of functions of the HMP 20.

Figure 14:
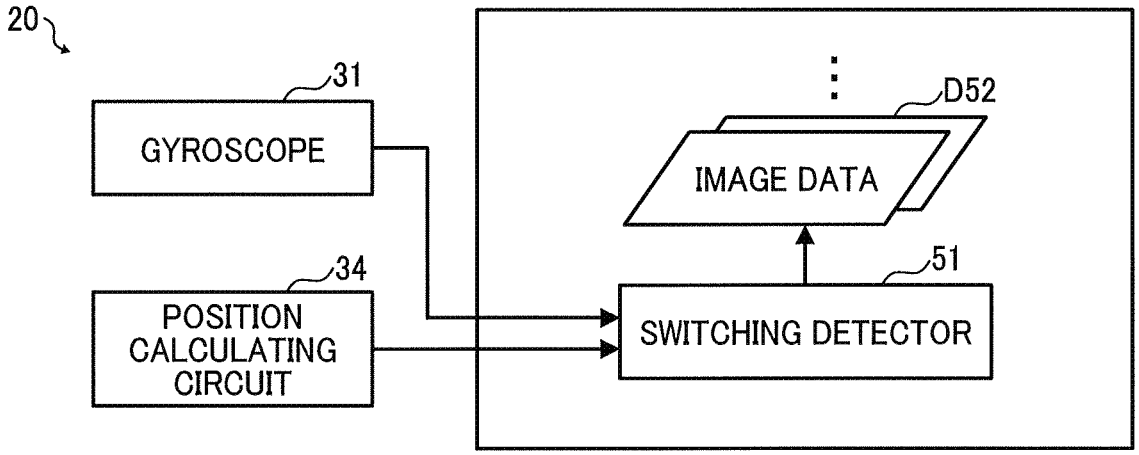
FIG. 14 is a block diagram of the HMP depicted in FIG. 6, illustrating functions thereof.

FIG. 14 is a block diagram of the HMP 20, illustrating the functions of the HMP 20 as one example. As illustrated in FIG. 14, the HMP 20 includes a switching detector 51. The switching detector 51 is a function, a functional component, or means achieved as the CPU 33 of the HMP 20 executes a program stored in the ROM 28. The switching detector 51 detects a switching motion performed by the user based on at least one of the angular velocity of the HMP 20 detected by the gyroscope 31 and the position of the HMP 20 detected by the position calculating circuit 34, thus switching image data D52. The switching detector 51 detects one piece or more of the image data D52. According to this embodiment, the switching detector 51 detects two pieces or more of the image data D52. The image data D52 is sent from the image data output device 11 to the HMP 20 as a single print job.

A description is provided of processes performed by the HMP 20.

Figure 15:
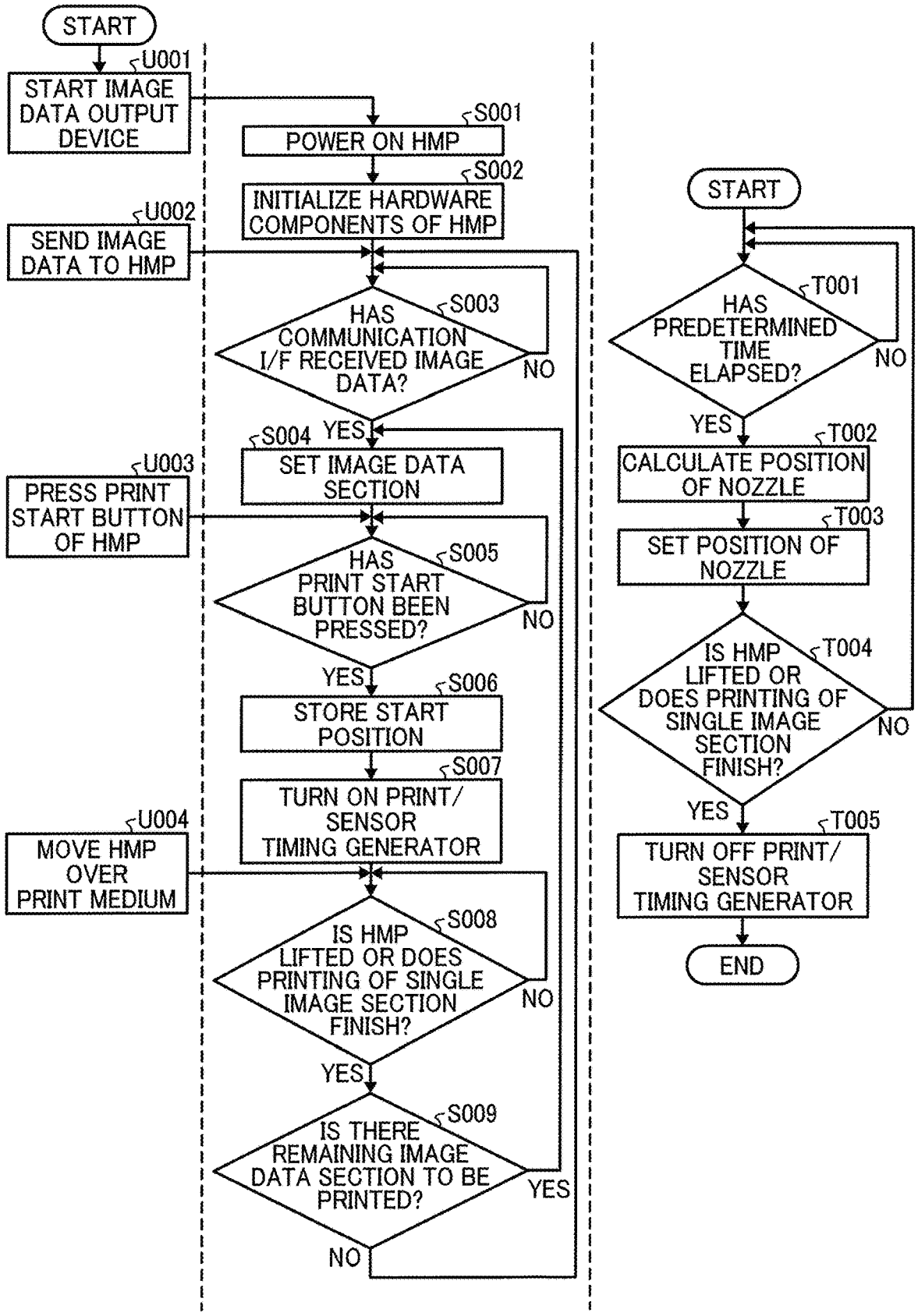
FIG. 15 is a flowchart of processes performed by the image data output device depicted in FIG. 4A and the HMP depicted in FIG. 4B.

FIG. 15 is a flowchart of processes performed by the image data output device 11 and the HMP 20 as one example. In FIG. 15, a left column illustrates the processes performed by the user with the image data output device 11 or the HMP 20. A center column illustrates the entire processes performed by the HMP 20. A right column illustrates the processes performed whenever the position of the nozzle 61 is calculated.

In step U001, the user presses a power button of the image data output device 11. Accordingly, the image data output device 11 acknowledges pressing of the power button and starts as power is supplied from a battery or the like.

In step S001, the user powers on the HMP 20 to start the HMP 20. In step S002, the CPU 33 of the HMP 20 initializes the hardware components depicted in FIGS. 5 and 6 installed in the HMP 20. For example, the CPU 33 initializes a register of the navigation sensor I/F 42 and the gyroscope I/F 45 and sets a timing value to the print/sensor timing generator 43. The CPU 33 establishes communication between the HMP 20 and the image data output device 11.

In step U002, the user selects the image data D52 according to which the image 52 is printed by using the image data output device 11. The user instructs the image data output device 11 to send the image data D52 to the HMP 20. Accordingly, the image data output device 11 acknowledges selection and sending of the image data D52. The user selects document data created by software such as a word processing application as the image data D52. Alternatively, the user may select image data in joint photographic experts group (JPEG) or the like as the image data D52. A printer driver may change data other than image data into the image data D52, if necessary.

When initialization finishes, the communication I/F 27 of the HMP 20 receives the image data D52 from the image data output device 11. In step S003, the CPU 33 determines whether the communication IN 27 has received the image data D52.

When reception of the image data D52 finishes (YES in step S003), the CPU 33 sets the first image data section, that is formed into the first image section 52*a*, of the image data D52 in step S004. For example, the CPU 33 sets the image data D52 by moving a part of the image data D52 stored in the DRAM 29 to the image RAM 37.

In step U003, the user places the HMP 20 at the start position on the print medium 12 and presses a print start button as an instruction to start printing.

The OPU 26 receives the instruction from the user and the CPU 33 determines whether the user has pressed the print start button in step S005.

If the CPU 33 determines that the user has pressed the print start button (YES in step S005), the CPU 33 stores coordinates (0, 0), for example, in the DRAM 29 or a register or the like of the CPU 33 as the start position in step S006. Thus, the user switches the image data D52 with a simple operation of pressing the print start button and therefore is immune from operations such as reselection of the image data D52.

In step S007, the CPU 33 turns on the print/sensor timing generator 43. Accordingly, the print/sensor timing generator 43 instructs timing to the navigation sensor I/F 42 and the IJ recording head controller 44 periodically. Consequently, the nozzle 61 starts discharging an ink droplet periodically and the interrupt controller 41 causes interruption periodically.

In step U004, the user grasps and moves the HMP 20 manually and freely to scan the print medium 12. Hence, the HMP 20 forms the image 52 on the print medium 12 gradually.

When printing starts, the switching detector 51 of the HMP 20 determines whether the HMP 20 is lifted from the print medium 12 or printing of a single image section (e.g., one of the first image section 52*a*, the second image section 52*b*, and the third image section 52*c*) of the image 52 finishes in step S008. Although determination in step S008 is identical to determination in step T004, determination in step T004 is also illustrated in step S008 because determination in step T004 is described clearly in the entire processes performed by the HMP 20.

Referring to FIGS. 16A, 16B, 16C, and 16D, a description is provided of determination in step S008.

Figure 16A:
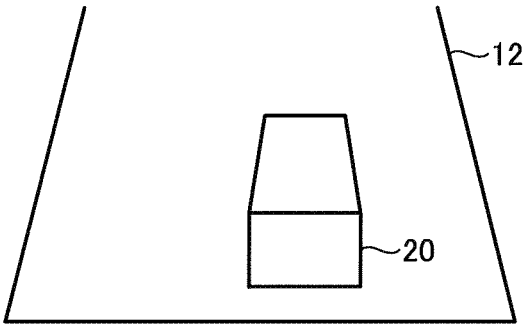
FIG. 16A is a perspective view of the HMP and the print medium depicted in FIG. 4B, illustrating the HMP placed on the print medium.
Figure 16B:
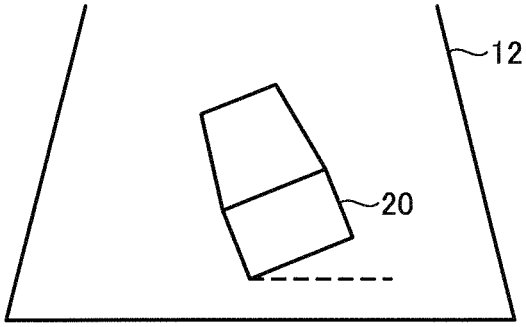
FIG. 16B is a perspective view of the HMP and the print medium depicted in FIG. 16A, illustrating the HMP that is tilted.
Figure 16C:
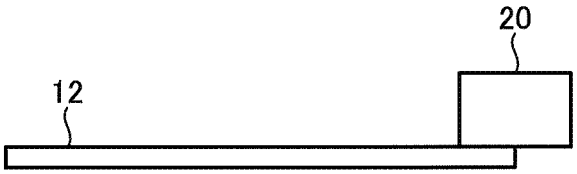
FIG. 16C is a side view of the HMP and the print medium depicted in FIG. 16A, illustrating the HMP situated at an edge of the print medium.

FIGS. 16A, 16B, 16C, and 16D illustrate lifting of the HMP 20 and finishing of printing the image 52 as one example. FIGS. 16A, 16B, and 16C illustrate the HMP 20 and the print medium 12, for describing determination of lifting of the HMP 20 as one example. FIG. 16A is a perspective view of the HMP 20 and the print medium 12, illustrating the HMP 20 that is placed on the print medium 12. FIG. 16B is a perspective view of the HMP 20 and the print medium 12, illustrating the HMP 20 that is tilted.

As illustrated in FIG. 16B, if the gyroscope 31 detects that the HMP 20 rotates about a left edge of the HMP 20, that is, if the roll angle of the HMP 20 changes, the image array 305 does not receive reflected light from the print medium 12 as described with reference to FIG. 9. Since the navigation sensor 30 notifies the CPU 33 that an intensity of reflected light from the print medium 12 decreases to a level smaller than a threshold, the switching detector 51 detects lifting of the HMP 20. Similarly, the switching detector 51 detects lifting of the HMP 20 if the gyroscope 31 detects that the HMP 20 rotates about a right edge of the HMP 20. If the gyroscope 31 detects that the HMP 20 rotates about an upper edge or a lower edge of the HMP 20 also, that is, if the pitch angle of the HMP 20 changes, the switching detector 51 detects lifting of the HMP 20 similarly.

FIG. 16C is a side view of the HMP 20 and the print medium 12. Similarly, as illustrated in FIG. 16C, if the HMP 20 moves to an edge of the print medium 12 and the navigation sensor 30 protrudes beyond the print medium 12, the image array 305 receives reflected light having a decreased intensity from the print medium 12. Accordingly, if the navigation sensor 30 notifies the CPU 33 that the intensity of reflected light from the print medium 12 is smaller than the threshold, the switching detector 51 detects lifting of the HMP 20.

When the HMP 20 has postures illustrated in FIGS. 16B and 16C, the position calculating circuit 34 may find it difficult to calculate the position of the HMP 20. When the HMP 20 has a posture illustrated in FIG. 16C, the navigation sensor 30 detects that the HMP 20 is situated at a position outside a print region on the print medium 12 where the image 52 is formed.

Figure 16D:
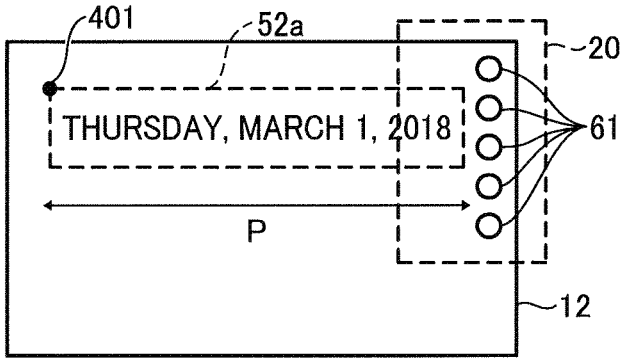
FIG. 16D is a plan view of the print medium and nozzles of the HMP depicted in FIG. 16A that are moved beyond a lateral edge of the first image section.

FIG. 16D is a plan view of the print medium 12. As illustrated in FIG. 16D, when the nozzles 61 move beyond a lateral edge of the first image section 52*a*, the CPU 33 determines that printing of the first image section 52*a* finishes. The lateral edge of the first image section 52*a* is a right edge of the first image section 52*a* when the HMP 20 moves rightward in FIG. 16D. If the HMP 20 moves rightward from a start position 401 situated on a left edge of the first image section 52*a*, when the HMP 20 moves horizontally for a length P of the first image section 52*a*, the nozzles 61 move beyond the lateral edge of the first image section 52*a*. In this case also, the navigation sensor 30 detects that the HMP 20 is situated at the position outside the print region on the print medium 12 where the image 52 is formed.

Alternatively, the CPU 33 may determine that printing of the first image section 52*a* finishes when the nozzles 61 have finished discharging ink droplets used to print the first image section 52*a*.

Referring back to FIG. 15, if the switching detector 51 determines that the HMP 20 is lifted from the print medium 12 or printing of the single image section of the image 52 finishes (YES in step S008), the switching detector 51 determines whether there is a remaining image data section to be printed in step S009. For example, the remaining image data section is a remaining line, that is, the second image section 52*b* or the third image section 52*c*. The switching detector 51 manages the number of image sections of the image 52 received in a single print job.

If the switching detector 51 determines that there is the remaining image data section (YES in step S009), step S004 is repeated. Thus, the CPU 33 sets the second image data section, which is formed into the second image section 52*b*, of the image data D52 in step S004.

If the switching detector 51 determines that there is no remaining image data section (NO in step S009), step S003 is repeated. Thus, the CPU 33 determines whether the communication I/F 27 has received next image data D52.

The processes illustrated in the right column in FIG. 15 start when the print/sensor timing generator 43 is turned on and repeat whenever the print/sensor timing generator 43 defines a timing.

Since the print/sensor timing generator 43 sets a predetermined time, the print/sensor timing generator 43 determines whether the predetermined time has elapsed in step T001.

If the print/sensor timing generator 43 determines that the predetermined time has elapsed in step T001, the navigation sensor I/F 42 obtains the moving amount from the navigation sensor 30 and the interrupt controller 41 interrupts the CPU 33. The CPU 33 causes the position calculating circuit 34 to calculate the position of the nozzle 61. Thus, the CPU 33 calculates the position of the nozzle 61 whenever the predetermined time elapses in step T002.

Subsequently, the CPU 33 sets the position of the nozzle 61 in step T003. For example, since the position of the nozzle 61 is determined, the CPU 33 causes the DMAC 38 to send data of the position of the nozzle 61 to the IJ recording head controller 44.

In step T004, the switching detector 51 determines whether the HMP 20 is lifted from the print medium 12 or printing of a single image section (e.g., one of the first image section 52*a*, the second image section 52*b*, and the third image section 52*c*) of the image 52 finishes. The switching detector 51 performs determination in step T004 similarly to step S008.

If the switching detector 51 determines that the HMP 20 is not lifted from the print medium 12 or printing of the single image section of the image 52 does not finish (NO in step T004), printing of the single image section continues. Accordingly, step T001 is repeated whenever the print/sensor timing generator 43 defines a timing.

If the switching detector 51 determines that the HMP 20 is lifted from the print medium 12 or printing of the single image section of the image 52 finishes (YES in step T004), printing of the single image section finishes. In step T005, the CPU 33 turns off the print/sensor timing generator 43.

A description is provided of examples of a printing method.

Figure 17A:
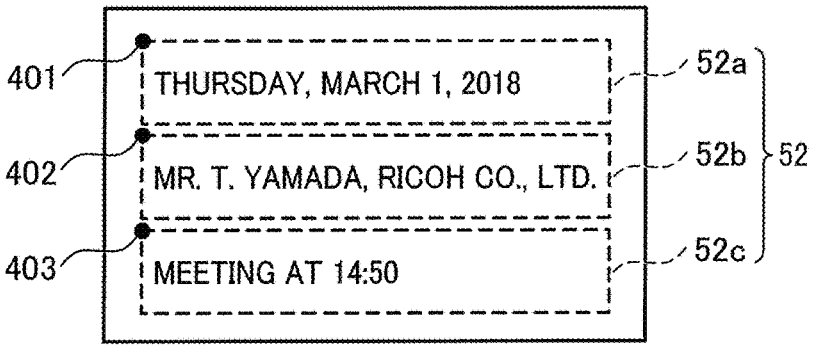
FIG. 17A is a plan view of the image depicted in FIG. 3A that is printed on a single page.

FIGS. 17A, 17B, 17C, and 17D illustrate diagrams for describing switching of image sections by lifting the HMP 20 from the print medium 12 as one example. FIG. 17A is a plan view of the image 52 that is printed on a single page and is constructed of three image sections, that is, the first image section 52*a*, the second image section 52*b*, and the third image section 53*c*. Under the printing method depicted in FIGS. 17A, 17B, 17C, and 17D, an original image constructed of a plurality of lines is printed as the image 52 such that the plurality of lines corresponds to the first image section 52*a*, the second image section 52*b*, and the third image section 52*c*, respectively. The image data output device 11 or the HMP 20 divides the original image into the first image section 52*a*, the second image section 52*b*, and the third image section 52*c* of the image 52. If the image data output device 11 divides the original image, since the original image is defined as document data constructed of a plurality of lines having line numbers, respectively, the image data output device 11 extracts each of the lines of the document data and converts the lines into the first image data section, the second image data section, and the third image data section to be formed into the first image section 52*a*, the second image section 52*b*, and the third image section 52*c*, respectively, of the single image 52.

The position of each of the first image section 52*a*, the second image section 52*b*, and the third image section 52*c* is initialized. The start position 401 where printing of the first image section 52*a* starts is at an upper left corner of the first image section 52*a*. A start position 402 where printing of the second image section 52*b* starts is at an upper left corner of the second image section 52*b*. A start position 403 where printing of the third image section 52*c* starts is at an upper left corner of the third image section 52*c*.

If the HMP 20 divides the original image into the plurality of image sections, that is, the first image data section, the second image data section, and the third image data section to be formed into the first image section 52*a*, the second image section 52*b*, and the third image section 52*c*, respectively, the HMP 20 detects a plurality of lines of the original image and associates the plurality of lines to the first image section 52*a*, the second image section 52*b*, and the third image section 52*c*, respectively. As a method for detecting the plurality of lines, the HMP 20 detects a circumscribed rectangle of each character and recognizes a plurality of circumscribed rectangles overlapping horizontally as a single line.

Figure 17B:
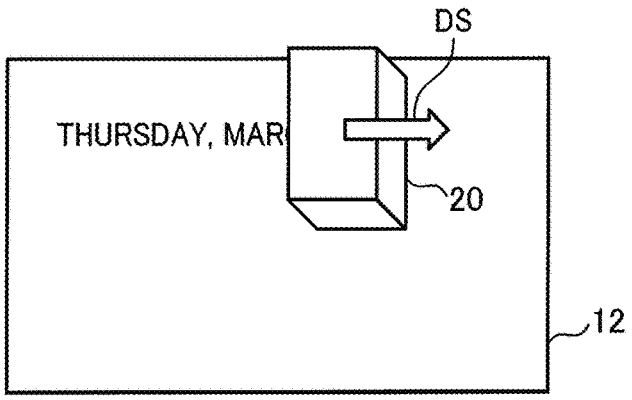
FIG. 17B is a perspective view of the HMP and the print medium depicted in FIG. 4B as one example of printing the first image section on the print medium.
Figure 17C:
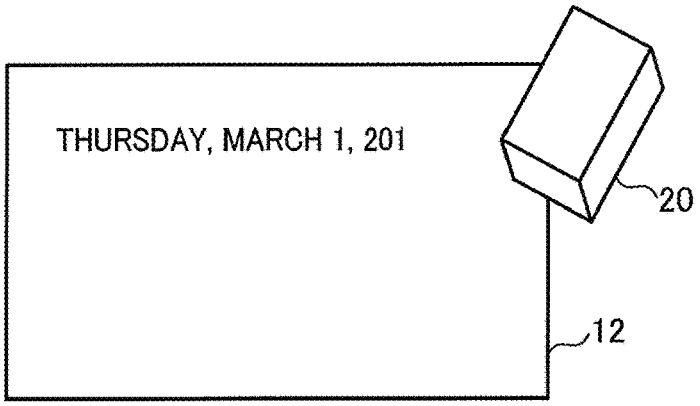
FIG. 17C is a perspective view of the HMP and the print medium depicted in FIG. 17B, illustrating the HMP lifted or moved to a right end of the print medium.
Figure 17D:
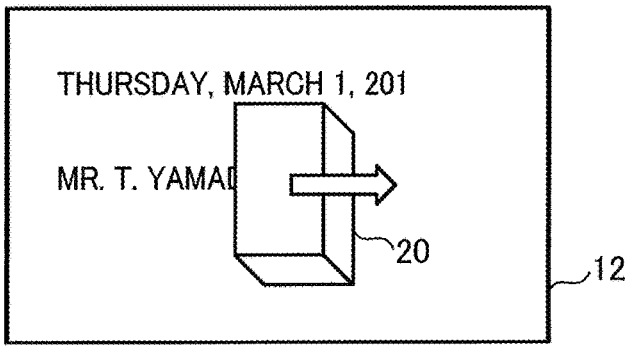
FIG. 17D is a perspective view of the HMP and the print medium depicted in FIG. 17B, illustrating the HMP that starts printing the second image section.

FIG. 17B illustrates one example of printing the first image section 52*a* on the print medium 12. As illustrated in FIG. 17C, when the user lifts the HMP 20 or moves the HMP 20 to a right end of the print medium 12, even during printing, the HMP 20 interrupts printing the first image section 52*a* according to the first image data section. As illustrated in FIG. 17D, when the user returns the HMP 20 onto the print medium 12 and presses the print start button to set the print start position of the second image section 52*b*, the HMP 20 starts printing the second image section 52*b* according to the second image data section.

As the HMP 20 is lifted from the print medium 12, the HMP 20 loses the present position. However, as the user presses the print start button, the user sets a new start position.

According to this embodiment, each of the first image section 52*a*, the second image section, 52*b*, and the third image section 52*c* is constructed of a plurality of characters on a single line for convenience of description. Alternatively, each of the first image section 52*a*, the second image section, 52*b*, and the third image section 52*c* may be constructed of a plurality of lines within a nozzle length for which the plurality of nozzles 61 is aligned in the vertical direction DV perpendicular to the scanning direction DS of the HMP 20.

A description of the nozzle length is provided below with reference to FIG. 20.

Figure 18:
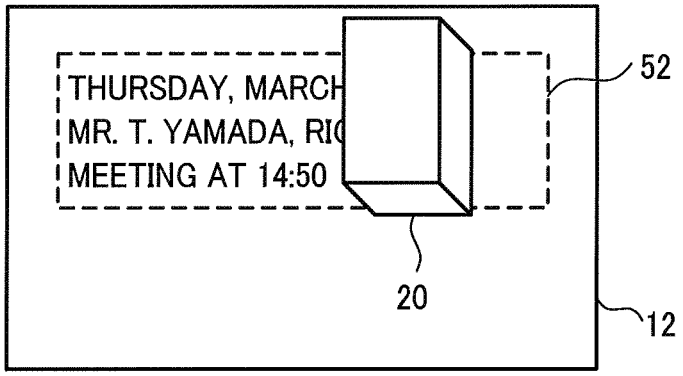
FIG. 18 is a plan view of a single image constructed of three lines.

FIG. 18 is a plan view of the single image 52 constructed of three lines as one example. As the user moves the HMP 20 rightward in FIG. 18 once, the HMP 20 prints the image 52 constructed of the three lines of character strings. Hence, as the number of lines that construct the image 52 increases, usability of the user improves. In this case, the image data output device 11 compares the nozzle length with a height of a single line including line spacing to determine the number of lines that construct the single image 52. Similarly, the HMP 20 compares the nozzle length with the height of the single line that is detected to determine the number of lines that construct the single image 52.

As described above, when the HMP 20 according to the first embodiment is lifted or when the HMP 20 finishes printing one of the first image section 52*a*, the second image section 52*b*, and the third image section 52*c* of the image 52, the HMP 20 cancels or interrupts a current printing of the one of the first image section 52*a*, the second image section 52*b*, and the third image section 52*c* and switches to a next printing of next one of the second image section 52*b* and the third image section 52*c*. Accordingly, the HMP 20 eliminates an operation by the user to switch from one to another of the first image section 52*a*, the second image section 52*b*, and the third image section 52*c* of the image 52, reducing a load imposed on the user.

A description is provided of a second embodiment of the present disclosure.

A handy mobile printer (HMP) 20S according to the second embodiment switches from one to another of the first image section 52*a*, the second image section 52*b*, and the third image section 52*c* of the image 52 when the HMP 20S moves for the nozzle length or greater vertically in Y-direction or horizontally in X-direction. For example, if the user moves the HMP 20S vertically for the nozzle length or greater, it is estimated that the user wishes to cause the HMP 20S to print a next image section.

The HMP 20S according to the second embodiment incorporates the components that are assigned with the identical reference numerals and operate as described in the first embodiment. Hence, the following may mainly describe main components of the HMP 20S according to the second embodiment.

Figure 19:
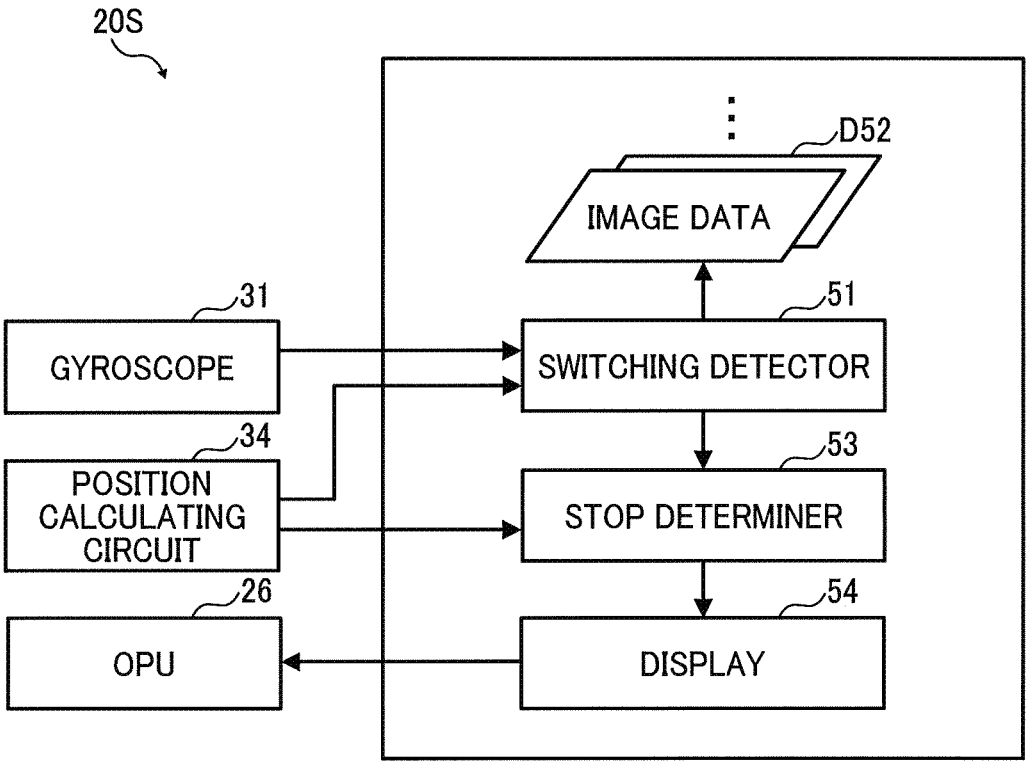
FIG. 19 is a block diagram of an HMP according to a second embodiment of the present disclosure.

FIG. 19 is a block diagram of the HMP 20S, illustrating functions of the HMP 20S as one example. Referring to FIG. 19, a configuration of the HMP 20S, which is different from the configuration of the HMP 20 depicted in FIG. 14, is mainly described below. In addition to the components depicted in FIG. 14, the HMP 20S includes a stop determiner 53 and a display 54. When the switching detector 51 detects switching motion performed by the user, the stop determiner 53 determines whether the HMP 20S stops relative to the print medium 12 for a predetermined time or greater. When the stop determiner 53 starts determining stoppage of the HMP 20S, the stop determiner 53 notifies the display 54 of starting of determination of stoppage. While the stop determiner 53 measures the predetermined time, the display 54 displays a measurement status of the predetermined time on a display device of the display 54.

Figure 20A:
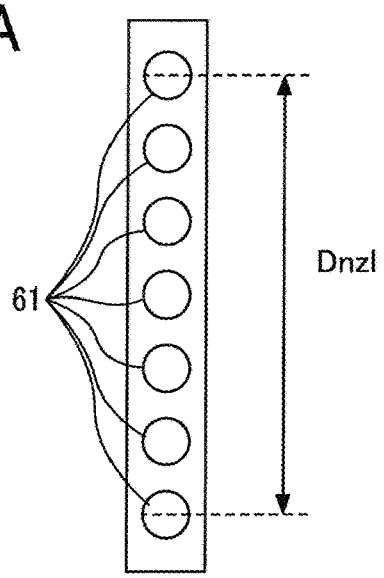
FIG. 20A is a plan view of the nozzles of the HMP depicted in FIG. 19.
Figure 20B:
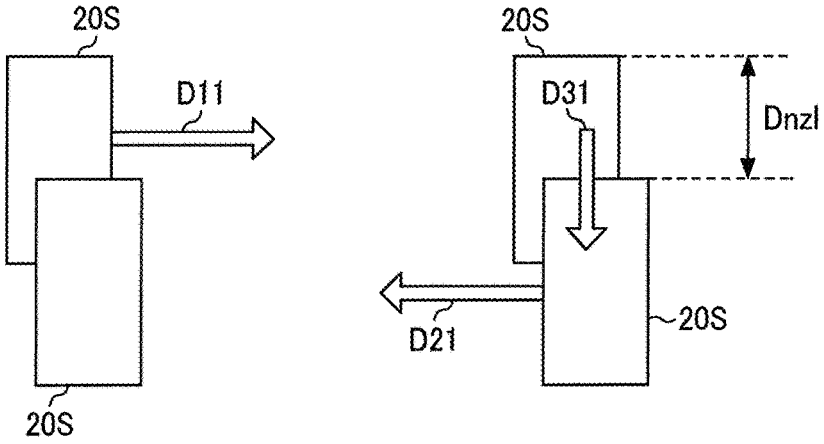
FIG. 20B is a plan view of the HMP depicted in FIG. 19 that is reciprocally moved horizontally to print two image sections.
Figure 20C:
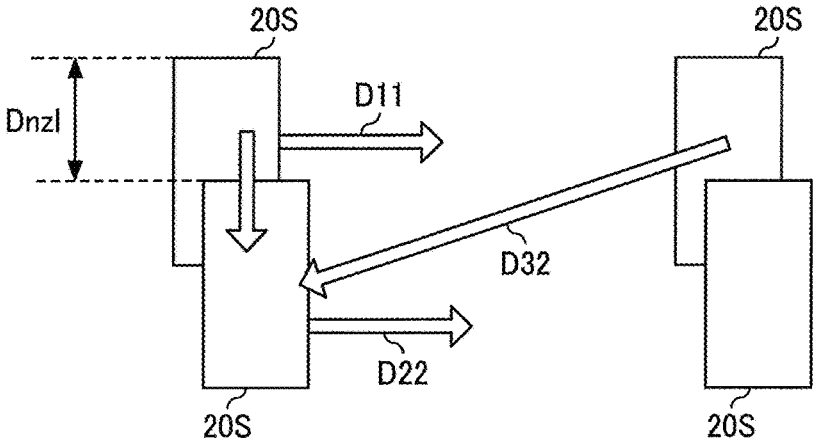
FIG. 20C is a plan view of the HMP depicted in FIG. 19 that is moved rightward to print two image sections.

FIGS. 20A, 20B, and 20C illustrate printing performed by the HMP 20S according to the second embodiment as one example. FIG. 20A is a plan view of the nozzles 61 having a nozzle length Dnzl. The nozzle length Dnzl defines a distance from a nozzle hole of the uppermost nozzle 61 to a nozzle hole of the lowermost nozzle 61.

FIG. 20B is a plan view of the HMP 20S reciprocally moved horizontally to print two image sections. The user moves the HMP 20S rightward in FIG. 20B in a direction D11 and then downward in a direction D31 for the nozzle length Dnzl. Accordingly, the HMP 20S cancels or interrupts printing a first image section (e.g., the first image section 52*a*) and starts printing a second image section (e.g., the second image section 52*b*). As the user moves the HMP 20S leftward in FIG. 20B in a direction D21, the HMP 20S prints the second image section.

FIG. 20C is a plan view of the HMP 20S moved rightward to print two image sections (e.g., the first image section 52*a* and the second image section 52*b*). The user moves the HMP 20S rightward in FIG. 20C in the direction D11 and then obliquely downward and leftward in a direction D32. Since the HMP 20S moves vertically for the nozzle length Dnzl or greater, the HMP 20S cancels or interrupts printing the first image section (e.g., the first image section 52*a*) and starts printing the second image section (e.g., the second image section 52*b*). As the user moves the HMP 20S rightward in FIG. 20C in a direction D22, the HMP 20S prints the second image section.

In either movement of the HMP 20S depicted in FIG. 20B or movement of the HMP 20S depicted in FIG. 20C, an origin of vertical movement of the HMP 20S to measure an amount of movement or displacement is the start position where the HMP 20S starts printing. A vertical length of each of the first image section and the second image section in the alignment direction of the nozzles 61 is not greater than the nozzle length Dnzl. Hence, the HMP 20S does not move for the nozzle length Dnzl or greater while the HMP 20S prints the first image section.

Vertical movement of the HMP 20S for the nozzle length Dnzl or greater in the direction D31 depicted in FIG. 20B and the direction D32 depicted in FIG. 20C is defined as starting a new line. The start position where the HMP 20S starts printing the second image section in FIGS. 20B and 20C is described below with reference to FIG. 21.

A description is provided of processes performed by the HMP 20S.

Figure 21:
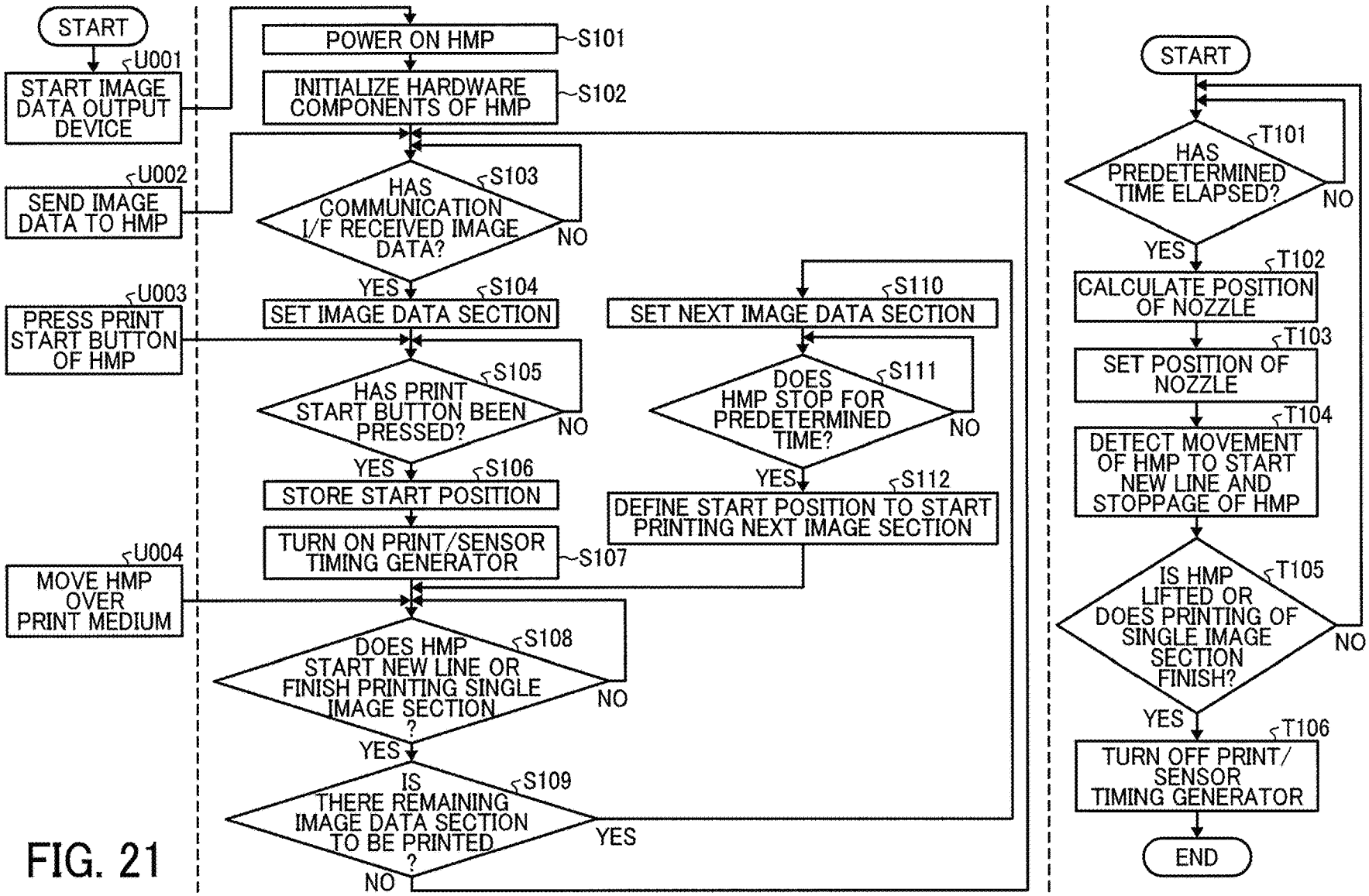
FIG. 21 is a flowchart of processes performed by the image data output device depicted in FIG. 4A and the HMP depicted in FIG. 19.

FIG. 21 is a flowchart of processes performed by the image data output device 11 and the HMP 20S as one example. In FIG. 21, a left column illustrates the processes performed by the user with the image data output device 11 or the HMP 20S. A center column illustrates the entire processes performed by the HMP 20S. A right column illustrates the processes performed whenever the position of the nozzle 61 is calculated. Referring to FIG. 21, the processes performed by the HMP 20S, which are different from the processes performed by the HMP 20 depicted in FIG. 15, are mainly described below.

The processes depicted in the left column in FIG. 21 are equivalent to the processes depicted in the left column in FIG. 15. Steps S101 to S107 depicted in the center column in FIG. 21 are equivalent to steps S001 to S007 depicted in the center column in FIG. 15. In step S108, the switching detector 51 determines whether the user moves the HMP 20S to start a new line or the HMP 20S finishes printing a single, first image section (e.g., the first image section 52*a*) of the image 52.

If the switching detector 51 determines that the user moves the HMP 20S to start a new line or the HMP 20S finishes printing the first image section of the image 52 (YES in step S108), the switching detector 51 determines whether there is a remaining image data section in step S109.

If the switching detector 51 determines that there is the remaining image data section (YES in step S109), the CPU 33 starts printing a next image section (e.g., the second image section 52*b*) according to the remaining image data section. In step S110, the CPU 33 sets the next image data section.

In step S111, the stop determiner 53 determines whether the HMP 20S stops relative to the print medium 12 for the predetermined time or greater. Thus, the stop determiner 53 determines the start position where the HMP 20S starts printing the next image section of the image 52. In order to adjust the start position where the HMP 20S starts printing the next image section of the image 52, the user may stop the HMP 20S for a short time and repeat motion to move the HMP 20S again. In order to distinguish stoppage of the HMP 20S for the short time from stoppage of the HMP 20S for the predetermined time, the predetermined time is preferably a certain long time. The display device of the display 54 displays the measurement status of the predetermined time to notify the user of the predetermined time.

Referring to FIGS. 22A, 22B, 22C, and 22D, a description is provided of a configuration of an interface used to display the measurement status of the predetermined time.

When the stop determiner 53 determines that the HMP 20S stops for the predetermined time, the CPU 33 defines a stop position where the HMP 20S stops as the start position where the HMP 20S starts printing the next image section in step S112. The start position is an upper left corner or an upper right corner of the next image section (e.g., the second image section 52*b* or the subsequent image section). The start position of the next image section is situated at one of three positions described below that are preset by the user. A first position is a left end of the next image section. A second position is a right end of the next image section. A third position is a nozzle position that is determined based on the first image section. Accordingly, if the user sets the left end of the next image section as the start position, the user moves the HMP 20S obliquely downward and leftward in the direction D32 as illustrated in FIG. 20C to start a new line. Conversely, if the user sets the right end of the next image section as the start position, the user moves the HMP 20S downward in the direction D31 as illustrated in FIG. 20B to start a new line. If the user sets the nozzle position that is determined based on the first image section as the start position, the user starts printing the next image section from an arbitrary position.

Thus, as the user presets the start position, the user selectively causes the HMP 20S to print, for example, by moving the HMP 20S reciprocally in the direction perpendicular to the alignment direction of the nozzles 61 or by moving the HMP 20S rightward in the direction perpendicular to the alignment direction of the nozzles 61.

If the user sets the left end or the right end of the next image section as the start position, the start position is updated. Accordingly, the first image section 52*a* (e.g., a character string) may not be parallel to the second image section 52*b* (e.g., a character string) as the next image section. In order to establish parallelism between the first image section 52*a* and the second image section 52*b*, the user aligns a body of the HMP 20S with an outer edge or a ruled line of the print medium 12.

Steps T101 to T103 depicted in the right column in FIG. 21 are equivalent to steps T001 to T003 depicted in the right column in FIG. 15. In step T104, the switching detector 51 detects movement of the HMP 20S to start a new line and stoppage of the HMP 20S. Based on detection in step T104, the switching detector 51 performs determination in step S107. Steps T105 and T106 are equivalent to steps T004 and T005.

When the stop determiner 53 determines that the HMP 20S stops for the predetermined time, the HMP 20S starts printing the next image section. Accordingly, the HMP 20S according to the second embodiment eliminates an operation by the user to press the print start button, reducing a load imposed on the user more than the HMP 20 according to the first embodiment.

Figure 22A:
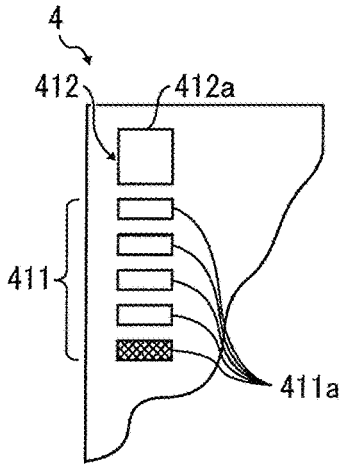
FIG. 22A is a plan view of a user interface, illustrating one of light-emitting diodes (LEDs) that light.
Figure 22B:
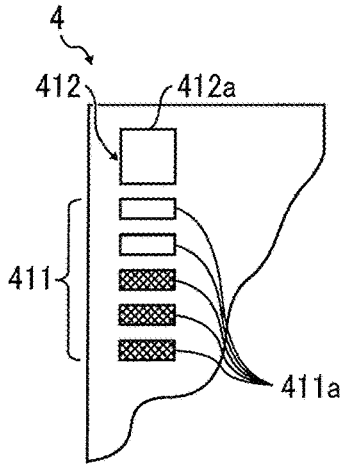
FIG. 22B is a plan view of the user interface depicted in FIG. 22A, illustrating three of the LEDs that light.
Figure 22C:
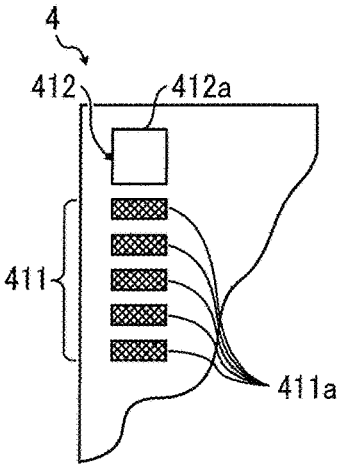
FIG. 22C is a plan view of the user interface depicted in FIG. 22A, illustrating five of the LEDs that light.

FIGS. 22A, 22B, 22C, and 22D illustrate a user interface 4 that notifies the user of the predetermined time as one example. FIGS. 22A, 22B, 22C, and 22D illustrate the user interface 4 that changes within the predetermined time. The user interface 4, as one example of the display device of the display 54, includes a time elapse indicator 411 and a print start indicator 412. The time elapse indicator 411 includes a plurality of light emitting diodes (LEDs) 411*a*. As time elapses, the LEDs 411*a* light successively from the lowermost LED 411*a*. FIG. 22A is a plan view of the user interface 4, illustrating one of the LEDs 411*a* that lights. FIG. 22B is a plan view of the user interface 4, illustrating three of the LEDs 411*a* that light. FIG. 22C is a plan view of the user interface 4, illustrating five of the LEDs 411*a* that light. Accordingly, the user interface 4 notifies the user of an elapsed time and a waiting time that remains.

Figure 22D:
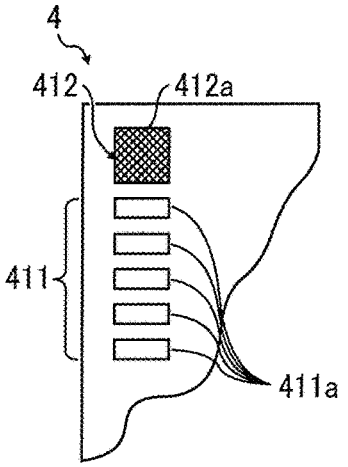
FIG. 22D is a plan view of the user interface depicted in FIG. 22A, illustrating another LED that lights.

The print start indicator 412 includes a single light emitting diode (LED) 412*a*. After all of the LEDs 411*a* of the time elapse indicator 411 light, the LED 412*a* of the print start indicator 412 lights. FIG. 22D is a plan view of the user interface 4, illustrating the LED 412*a* that lights. Accordingly, the user recognizes that the HMP 20S is ready for printing.

A color of light emitted from the LEDs 411*a* of the time elapse indicator 411 is preferably different from a color of light emitted from the LED 412*a* of the print start indicator 412. Hence, the user recognizes that the HMP 20S is ready for printing as the color of light emitted from the user interface 4 changes. The user interface 4 depicted in FIGS. 22A, 22B, 22C, and 22D is one example. Alternatively, the user interface 4 may be a liquid crystal panel that has similar indicators. As time elapses, the number of the LEDs 411*a* that light may decrease. When the HMP 20S is ready for printing, all of the LEDs 411*a* may light or blink. The user interface 4 may display a time in seconds counted until the HMP 20S is ready for printing. The user interface 4 may output music that stops when the HMP 20S is ready for printing.

A description is provided of another example of starting a new line.

The user moves the HMP 20S vertically for the nozzle length Dnzl or greater to start a new line. Alternatively, the user may move the HMP 20S horizontally to start a new line as illustrated in FIG. 20C. The user barely moves the HMP 20S horizontally without moving the HMP 20S vertically. Even if the user moves the HMP 20S horizontally without moving the HMP 20S vertically, since the nozzles 61 do not discharge ink droplets, a failure barely occurs. Hence, when the user moves the HMP 20S horizontally for a length greater than a length of a previous image section, the switching detector 51 determines that the HMP 20S starts a new line.

Figure 23:
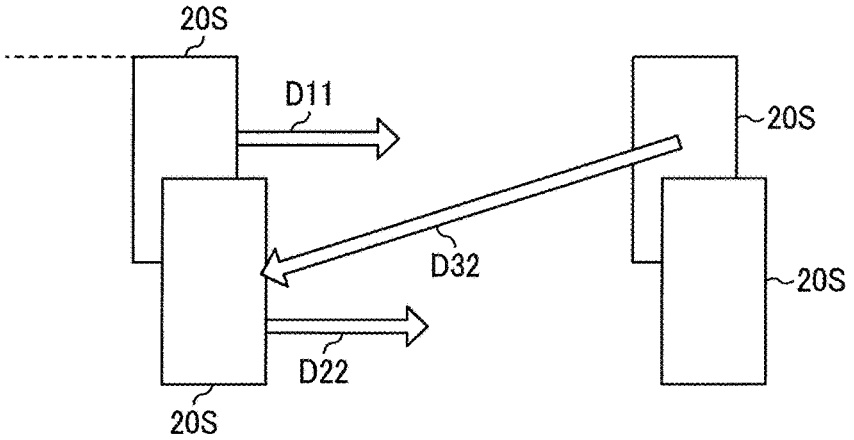
FIG. 23 is a diagram of the HMP depicted in FIG. 19 that moves horizontally to start a new line.

FIG. 23 is a diagram of the HMP 20S that moves horizontally to start a new line as one example. FIG. 23 illustrates the HMP 20S that moves leftward to start a new line. Alternatively, the HMP 20S may move rightward to start a new line as long as the HMP 20S moves in a direction opposite a direction in which the HMP 20S moves to print the previous image section. When the user moves the HMP 20S horizontally in the direction opposite the direction in which the HMP 20S moves to print the previous image section for the length greater than the length of the previous image section, the switching detector 51 determines that the HMP 20S starts a new line.

The switching detector 51 that determines as described above allows the user to move the HMP 20S in a direction other than a vertical direction. If the switching detector 51 is configured to determine whether the HMP 20S starts a new line based on a moving amount of the HMP 20S that moves vertically, the user is requested to move the HMP 20S for the nozzle length Dnzl. Accordingly, if the user moves the HMP 20S for a length smaller than the nozzle length Dnzl, the HMP 20S does not start a new line. Consequently, the user may move the HMP 20S vertically while the HMP 20S prints one image section.

Accordingly, if the user moves the HMP 20S rightward to print the image 52 on the print medium 12, the switching detector 51 detects that the HMP 20S starts a new line precisely based on the amount of movement of the HMP 20S that moves horizontally.

A description is provided of applications and variations of the HMP 20 and the HMP 20S.

The above-described embodiments are examples and are not limited to the above-described examples. The above-described embodiments are variously modified.

For example, each of the HMP 20 and the HMP 20S may be a handheld printer (HHP), a mobile printer, a handy printer, or the like.

The above-described embodiments use image data as text data. Alternatively, the image data may include an object such as a photograph, a figure, and a picture. A vertical length of each of a first object and a second object in the alignment direction of the nozzles 61 is not greater than the nozzle length Dnzl. In this case also, the user causes the HMP 20 and the HMP 20S to print a plurality of objects, that is, the first object and the second object, without pressing the print start button on the HMP 20 and the HMP 20S.

The components of each of the SoC 50 and the ASIC/FPGA 40 may be incorporated in either the SoC 50 or the ASIC/FPGA 40 according to performance of the CPU 33, the size of the circuit of the ASIC/FPGA 40, and the like.

In the HMP 20 and the HMP 20S according to the above-described embodiments, the nozzles 61 discharge ink to form an image. Alternatively, the HMP 20 and the HMP 20S may form an image by irradiating the print medium 12 with visible light, ultraviolet rays, infrared rays, laser beams, and the like. In this case, the print medium 12 is sensitive to heat and light, for example. Alternatively, the nozzle 61 may discharge transparent liquid. In this case, as light having a particular wavelength range irradiates the transparent liquid on the print medium 12, the user obtains visible information. Yet alternatively, the nozzle 61 may discharge metal paste, resin, or the like.

The number of the gyroscopes 31 is not limited to one. Each of the HMP 20 and the HMP 20S may incorporate two or more gyroscopes 31.

The position calculating circuit 34 is one example of a posture detector. The navigation sensor 30 is one example of a first sensor or a moving amount sensor. The gyroscope 31 is one example of a second sensor or an angular velocity sensor. The switching detector 51 is one example of a switcher. The stop determiner 53 is one example of a stop determiner. The display 54 is one example of a display.

A description is provided of advantages of a liquid droplet discharging apparatus (e.g., the HMP 20 and the HMP 20S).

As illustrated in FIGS. 6 and 14, the liquid droplet discharging apparatus includes at least one moving amount sensor as a first sensor (e.g., the navigation sensor 30), an angular velocity sensor as a second sensor (e.g., the gyroscope 31), a posture detector (e.g., the position calculating circuit 34), and a switcher (e.g., the switching detector 51).

The liquid droplet discharging apparatus, which is movable, receives image data including a first image data section (e.g., the first image data section to be formed into the first image section 52*a*) and a second image data section (e.g., the second image data section to be formed into the second image section 52*b*) and discharges a liquid droplet onto a medium (e.g., the print medium 12) according to the first image data section and the second image data section. The moving amount sensor detects a moving amount of the liquid droplet discharging apparatus. The angular velocity sensor detects an angular velocity of the liquid droplet discharging apparatus. The posture detector detects a posture of the liquid droplet discharging apparatus according to the detected angular velocity. The switcher switches from the first image data section to the second image data section based on at least one of the moving amount and the posture of the liquid droplet discharging apparatus.

Accordingly, the liquid droplet discharging apparatus switches from the first image data section to the second image data section readily.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present invention.

Any one of the above-described operations may be performed in various other ways, for example, in an order different from the one described above.

What is claimed is:

1. A liquid droplet discharging apparatus being movable and comprising:

a plurality of nozzles to discharge a liquid droplet onto a medium according to a first image data section and a second image data section of image data;

a moving amount sensor to detect a moving amount of the liquid droplet discharging apparatus; and circuitry configured to switch from the first image data section to the second image data section;

a housing which is of a size to be held and moved by a single hand which includes therein the plurality of nozzles, the moving amount sensor, and the circuitry configured to switch; and a sensor to detect whether the liquid droplet discharging apparatus is lifted off of the medium, wherein the circuitry configured to switch is configured to perform the switch from the first image data section to the second image data section in a plurality of the image data included in print data for one page when the sensor detects that the liquid droplet discharging apparatus is lifted.

2. The liquid droplet discharging apparatus according to claim 1, further comprising an angular velocity sensor to detect an angular velocity of the liquid droplet discharging apparatus, wherein the circuitry configured to switch switches from the first image data section to the second image data section based on at least one of the detected moving amount and the detected angular velocity.

3. The liquid droplet discharging apparatus according to claim 2, wherein the moving amount sensor includes a navigation sensor and the angular velocity sensor includes a gyroscope.

4. The liquid droplet discharging apparatus according to claim 2, further comprising a posture detector to detect a posture of the liquid droplet discharging apparatus based on the detected angular velocity, wherein the circuitry configured to switch switches from the first image data section to the second image data section based on at least one of the detected moving amount and the detected posture.

5. The liquid droplet discharging apparatus according to claim 4, wherein the circuitry configured to switch switches from the first image data section to the second image data section when the posture detector detects that the liquid droplet discharging apparatus is lifted from the medium.

6. The liquid droplet discharging apparatus according to claim 1, wherein the circuitry configured to switch switches from the first image data section to the second image data section when the moving amount sensor detects that the plurality of nozzles moves to a position outside a pixel position on the medium onto which the plurality of nozzles discharges the liquid droplet according to the first image data section.

7. The liquid droplet discharging apparatus according to claim 1, wherein the circuitry configured to switch switches from the first image data section to the second image data section when the moving amount sensor detects the moving amount that is greater than a predetermined length in a direction perpendicular to a scanning direction in which the plurality of nozzles moves to discharge the liquid droplet.

8. The liquid droplet discharging apparatus according to claim 7, wherein the predetermined length is a nozzle length for which the plurality of nozzles is aligned in the direction perpendicular to the scanning direction.

9. The liquid droplet discharging apparatus according to claim 1, wherein the circuitry configured to switch switches from the first image data section to the second image data section when the moving amount sensor detects the moving amount that is greater than a length of an image printed on the medium according to the first image data section in a scanning direction in which the plurality of nozzles moves to discharge the liquid droplet.

10. The liquid droplet discharging apparatus according to claim 1, further comprising stop determiner circuitry to detect that the liquid droplet discharging apparatus stops for a predetermined time.

11. The liquid droplet discharging apparatus according to claim 10, further comprising a central processing unit to determine a start position where the plurality of nozzles discharges the liquid droplet onto the medium according to the second image data section when the stop determiner circuitry detects that the liquid droplet discharging apparatus stops for the predetermined time.

12. The liquid droplet discharging apparatus according to claim 10, further comprising a display to display a measurement status of the predetermined time.

13. The liquid droplet discharging apparatus according to claim 12, wherein the display includes a user interface including:

a time elapse indicator including a plurality of light emitting diodes to light successively; and a print start indicator to light after the light emitting diodes of the time elapse indicator light.

14. A liquid droplet discharging method comprising:

discharging a liquid droplet onto a medium according to a first image data section and a second image data section;

moving a housing of a liquid droplet discharging apparatus by a single hand;

detecting a moving amount of the liquid droplet discharging apparatus; and switching from the first image data section to the second image data section, wherein the liquid droplet discharging apparatus prints the sections by:

printing the first image data section;

being lifted off of the medium by the single hand;

being set down at a different position on the medium; and printing the second image data section, wherein the switching performs switching from the first image data section to the second image data section in a plurality of the image data included in print data for one page when a sensor detects that the liquid droplet discharging apparatus is lifted.

15. The liquid droplet discharging method according to claim 14, further comprising:

detecting an angular velocity of the liquid droplet discharging apparatus; and switching from the first image data section to the second image data section based on at least one of the detected moving amount and the detected angular velocity.

16. A non-transitory computer readable medium storing a plurality of instructions, which when executed by one or more processors, causes the processors to perform a method, the method comprising:

discharging a liquid droplet onto a medium according to a first image data section and a second image data section;

detecting a moving amount of a housing of a liquid droplet discharging apparatus which has been moved by a single hand; and switching from the first image data section to the second image data section, wherein the liquid droplet discharging apparatus prints the sections by:

printing the first image data section;

being lifted off of the medium by the single hand;

being set down at a different position on the medium; and printing the second image data section, wherein the switching performs switching from the first image data section to the second image data section in a plurality of the image data included in print data for one page when a sensor detects that the liquid droplet discharging apparatus is lifted.

17. The non-transitory computer readable medium according to claim 16, wherein the method further comprises:

detecting an angular velocity of the liquid droplet discharging apparatus; and switching from the first image data section to the second image data section based on at least one of the detected moving amount and the detected angular velocity.

* * * * *